US006601547B2

(12) United States Patent
Al-Hawaj

(10) Patent No.: US 6,601,547 B2
(45) Date of Patent: Aug. 5, 2003

(54) AXIAL PISTON ROTARY POWER DEVICE

(76) Inventor: Osama M. Al-Hawaj, P.O. Box 15462, Daiyah (KW), 35455

( * ) Notice: Subject to any disclaimer, the term of this patent is extended or adjusted under 35 U.S.C. 154(b) by 18 days.

(21) Appl. No.: 09/977,633

(22) Filed: Oct. 15, 2001

(65) Prior Publication Data

US 2003/0070633 A1 Apr. 17, 2003

(51) Int. Cl.[7] ..... F02B 57/00
(52) U.S. Cl. ..... 123/56.1; 123/43 AA
(58) Field of Search ..... 123/43 AA, 56.1

(56) References Cited

U.S. PATENT DOCUMENTS

| | | | | | |
|---|---|---|---|---|---|
| 1,209,995 | A | * | 12/1916 | Ord | 123/43 AA |
| 1,774,713 | A | * | 9/1930 | Jahn et al. | 123/56.1 |
| 1,945,727 | A | * | 2/1934 | Braunwalder | 123/56.1 |
| 2,949,100 | A | * | 8/1960 | Petersen | 123/43 AA |
| 3,068,709 | A | * | 12/1962 | Petersen | 123/43 AA |
| 3,945,359 | A | * | 3/1976 | Asaga | 123/56.1 |
| 4,287,858 | A | | 9/1981 | Anzalone | |
| 5,103,778 | A | | 4/1992 | Usich, Jr. | |
| 5,209,190 | A | * | 5/1993 | Paul | 123/43 AA |
| 5,253,983 | A | | 10/1993 | Suzuki et al. | |
| 5,813,372 | A | | 9/1998 | Manthey | |
| 6,145,429 | A | * | 11/2000 | Paul | 123/43 AA |
| 6,155,214 | A | * | 12/2000 | Manthey | 123/43 AA |

* cited by examiner

*Primary Examiner*—Henry C. Yuen
*Assistant Examiner*—Jason Benton
(74) *Attorney, Agent, or Firm*—David Kiewit

(57) ABSTRACT

An axial piston rotary power device has a housing enclosing a cylindrical chamber. An axially undulating guide cam is medially fixed to the inner annular wall of the chamber. A central cylindrical stator protrudes axially through the chamber from one end of the housing. The stator has lateral intake and discharge ports communicating with axial channels for conveying working fluid to and from the chamber. A rotary cylindrical block has a plurality of closed-ended cylindrical bores parallel to and spaced apart at equal angular intervals around a central bore. The block rotatably encloses the central cylindrical stator. Each closed-ended cylindrical bore has, at each end, a radially inward opening through the central bore and axially aligned with lateral ports in the central stator. A plurality of double-acting pistons are slidably received in the bores. Each piston has a medial stub shaft protruding through a slot parallel to the axis. The stub shafts have respective cam followers that engage the surrounding undulating cylindrical guide cam. The action of the cam followers on the guide cam imparts rotation to the cylindrical block when the pistons reciprocate within their respective bores. Each of the end openings alternately registers with respectively aligned intake and discharge ports as the cylinder block rotates. Various embodiments of the rotary power device, which differ in the structure of the central stator, can serve as a four-stroke internal combustion engine, a compressor, a pump, a fluid-driven motor or an expander device.

31 Claims, 28 Drawing Sheets

AXIAL PISTON ROTARY POWER DEVICE

BACKGROUND OF THE INVENTION

1. Field of the Invention

The invention relates to axial piston rotary power device having one or more pistons disposed parallel to and displaced from an axis of rotation. More particularly, the invention relates to internal combustion engines, pumps, compressors, expanders and fluid motors. It additionally relates to any two such devices that differ in a simple structural modification of a central cylindrical stationary member.

2. Background Information

This invention relates to rotary power devices of the type having a plurality of cylinders arranged around and parallel to a central axis of rotation in an equally-spaced relationship, and in which pistons disposed within the cylinders cooperate with a cam track to impart rotational motion to a rotor when the pistons reciprocate in their respective cylinders. Examples of rotary devices of the above type can be found in United States patent specifications such as U.S. Pat. No. 5,813,372 of Manthey; U.S. Pat. No. 4,287,858 of Anzalone; U.S. Pat. No. Re. 30,565 and U.S. Pat. No. 4,157,079 of Kristiansen; U.S. Pat. No. 5,209,190 of Paul; U.S. Pat. No. 5,103,778 of Usich, Jr.; U.S. Pat. No. 5,253,983 of Suzuki, et al.; U.S. Pat. No. 5,323,738 of Morse; U.S. Pat. No. 4,213,427 of Di Stefano; and U.S. Pat. No. 1,614,476 of Hutchinson. Although such power devices have been proven to be theoretically functional, they are characterized in some respects by complexities associated with the arrangements of cams and of intake and discharge means, which make them costly to manufacture, assemble, and maintain.

BRIEF SUMMARY OF THE INVENTION

An axial piston rotary power device of the invention comprises a stator portion and a rotor portion that has a rotatable shaft extending along an axis of the device. The stator portion of the device comprises an external stator portion defining a generally cylindrical interior bounded by a back plate portion and a front plate portion that has a central throughhole within which the rotatable shaft is journaled. In addition, the stator comprises a cylindrical internal stator portion projecting from the back plate portion into the cylindrical interior along the axis of the device so as to define an annular space extending between the internal and external stator portions. The internal stator portion has a plurality of passageways within it, each of the passageways comprising a channel parallel to the axis and each of the channels communicating with at least one respective radially oriented port formed in the internal stator at a respective selected axial position. Yet another static portion of the device is an axially undulating guide track surface that may be incised into an internal wall of the external stator portion, or that may be formed from separate tubular elements fixedly attached to either the front or back plates. The rotor portion of the device comprises a cylindrical block fixedly attached to the shaft arid rotatable within the annular space between the internal stator portion and the guide track surface. This block has a central cylindrical bore adapted to receive the internal stator, and also includes a selected number of working cylinders parallel to the axis of the device. Each of the working cylinders is spaced apart from the axis of the device by a single selected radial distance, and each of the working cylinders has a radially inwardly directed end opening adjacent each of its two ends. One of the end openings of each cylinder communicates with the central cylindrical bore at a first of the selected axial positions, the second of the end openings of each cylinder communicates with the central cylindrical bore at a second of the selected axial positions. In addition, each of the working cylinders also has a respective axial cam follower slot extending outwardly through an outer wall of the cylindrical block. Each of the cylinders has a respective piston slidably received within it, and each of the pistons is connected to a respective cam follower by means of a respective pin extending outwardly through the respective cam follower slot. All of the cam followers engage the undulating guide surface so as to couple a rotary motion of the block to the reciprocating translational motions of the pistons. If the pistons are driven to and fro within the cylinders by known means such as the expansion of an explosive air-fuel charge, or by the introduction of a pressurized working fluid, the rotary power device of the invention can function as an internal combustion engine or as a fluid-driven motor or expander providing output shaft power. Conversely, if the block is rotated by the application of a torque to the input shaft, the rotary power device of the invention can function as a pump or compressor.

One embodiment of the present invention provides an improved spark ignition rotary internal combustion engine which operates in a four-cycle mode and which overcomes problems presently encountered in the class of rotary engine having pistons positioned parallel to each other around a common axis of rotation. Another embodiment of the present invention provides an improved rotary internal combustion engine which operates in a two-cycle mode and which overcomes problems presently encountered in the class of rotary engine having pistons positioned parallel to each other around a common axis of rotation.

A preferred embodiment of the invention provides a rotary power device having valveless ports.

A feature of some embodiments the invention is that they are light in weight, small in size and have a reduced part count when compared with prior art rotary power devices.

Another feature of a preferred rotary power device of the invention is that it can be easily converted to another type of rotary power device by a simple modification or replacement of a central stationary member. Thus, one can convert an internal combustion engine of the invention into a rotary power device that can act as any one of a pump, a compressor, a fluid-driven pump, a fluid-driven compressor and a fluid-driven motor.

A benefit of some embodiments of the invention is that they provide a rotary power device that closely approximates continuous intake, compression, combustion and discharge processes.

Another benefit of some embodiments of the invention is that they provide a rotary power device characterized by reduced noise and vibration.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figures 10, 10A, 10B, 10F:
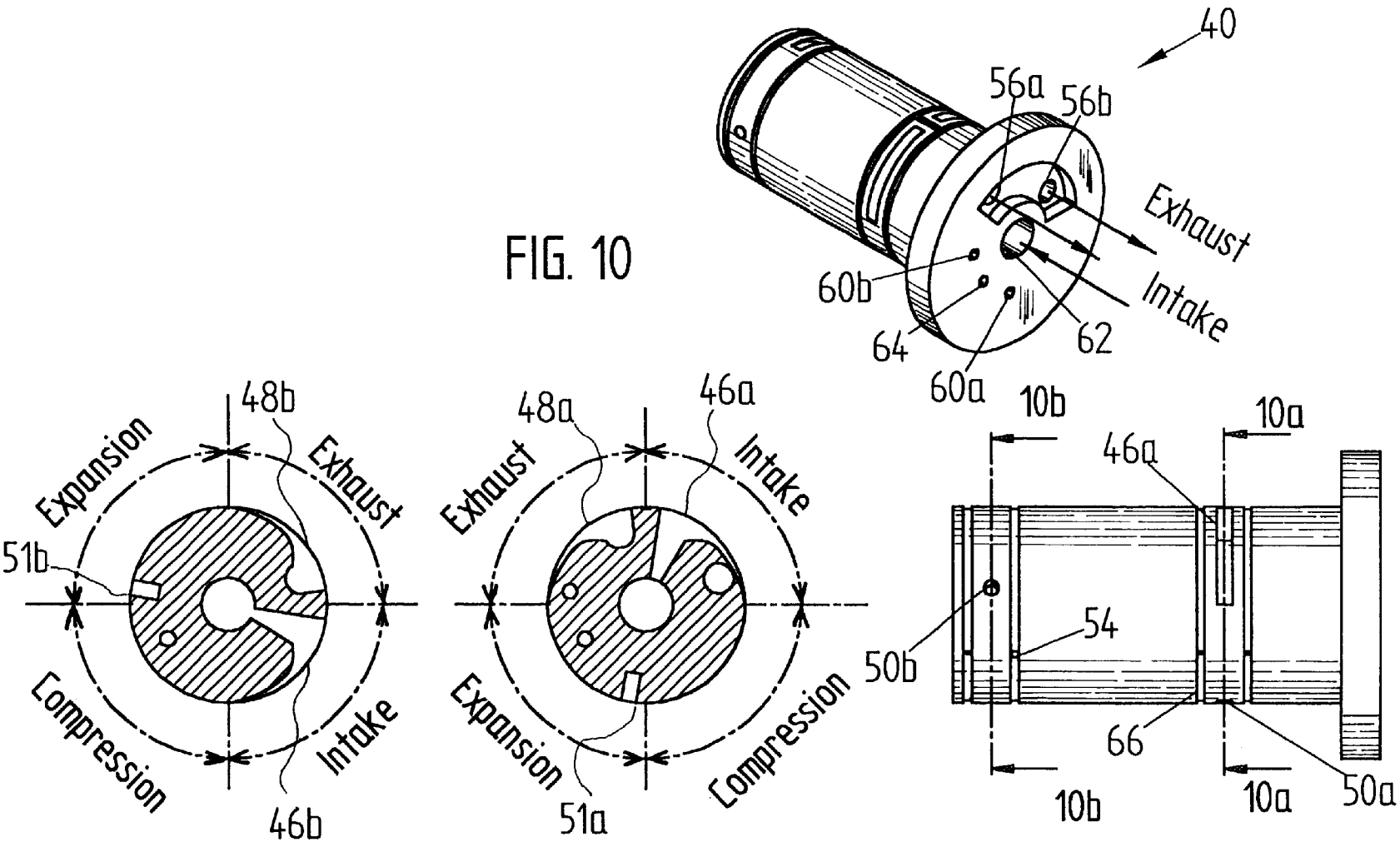
FIG. 10 is another isometric view of the central stator of FIG. 4 illustrating a four stroke internal combustion engine.
FIG. 10*f* is a side view of FIG. 10.
FIG. 10*a* is a section view taken along 10*a*—10*a* of FIG. 10*f*.
FIG. 10*b* is a sectional view taken along 10*b*—10*b* of FIG. 10*f*.
Figure 11:
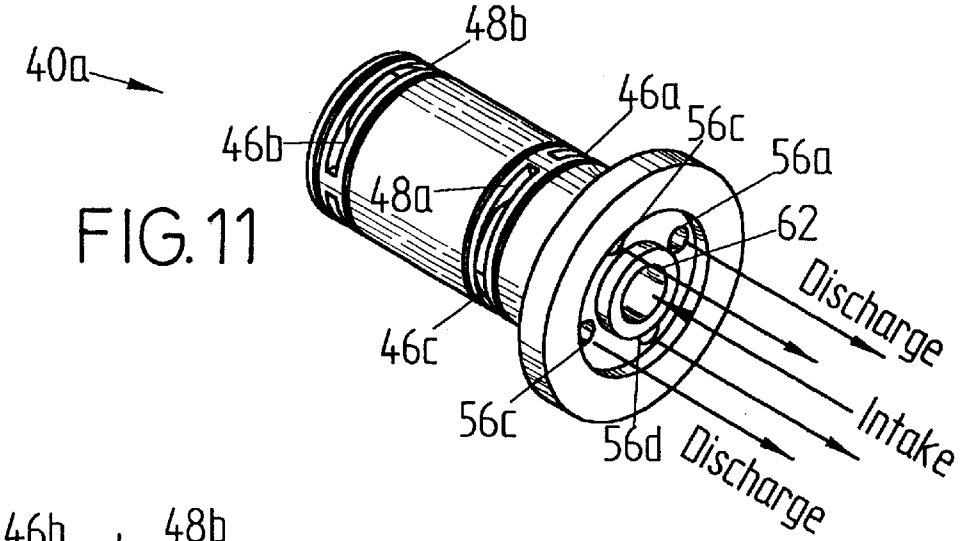
FIG. 11 is an isometric view of alternative central stator of the power device operating as a four-stroke pump, compressor, fluid-driven motor or expander device.
Figure 19:
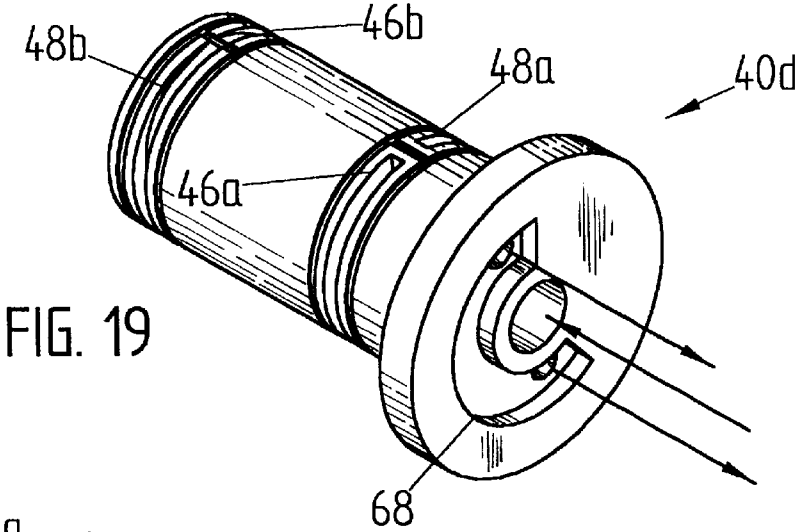
FIG. 19 is an isometric view of alternative internal stator for the power device of FIG. 15, the alternative internal stator used when the device operates as a two-stroke pump, compressor, fluid-driven motor or expander.
Figure 19F:
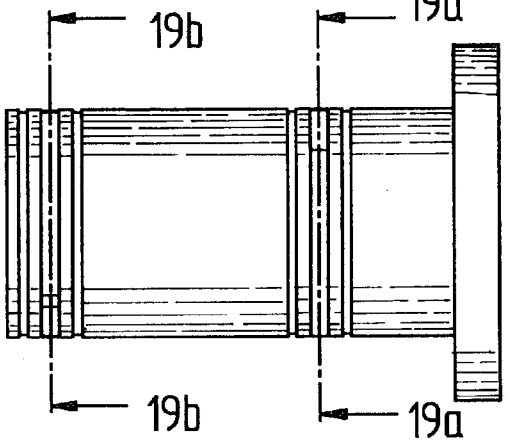
FIG. 19*f* is a side view of FIG. 19.
Figure 19A:
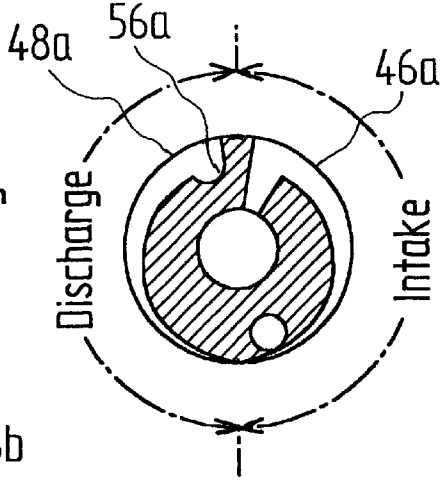
FIG. 19*a* is a sectional view taken along line 19*a*—19*a* of FIG.19*f*.
Figure 19B:
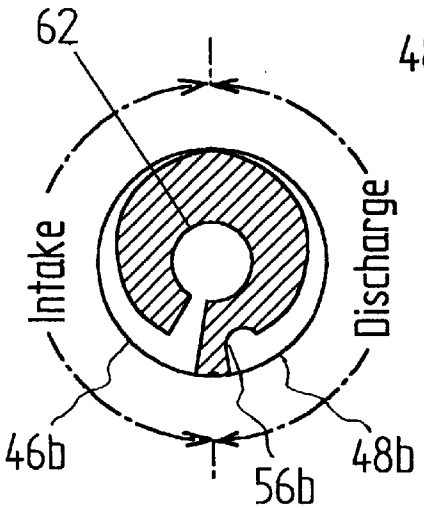
FIG. 19*b* is a sectional view taken along line 19*b*—19*b* of FIG. 19*f*.

FIGS. 1–10, illustrate the principles of this invention through its application as a four-stroke internal combustion engine. FIGS. 12–18 illustrate the principles of this invention through its operation as a two-stroke internal combustion engine. A complete reading of the disclosure will lead one skilled in the art will to understand that these same principles can be successfully employed to yield other devices such as four-stroke and two-stroke pumps, compressors, fluid-driven motors or expander devices as shown in FIGS. 11 and FIG. 19, respectively, through a simple modification or replacement of the central stationary member.

Referring to FIGS. 1–10, the depicted embodiment of the rotary power device 13 of the invention comprises a stationary housing 10 having a generally cylindrical interior. The housing, or external stator 10, preferably comprises a middle portion 12 having a generally cylindrical interior that is closed off at its ends by a front end plate 14 having a central opening 18 and a back end plate 16. The end plates 14 and 16 are preferably secured to the middle portion 12 of the stationary housing by tie rods and bolts or other known fastening means (not shown). A generally cylindrical internal stator 40 extends along an axis 89 of the device into the interior of the housing 10 from the end plate opening 18 and is fixedly attached to the back end plate 16 by bolts or other suitable fastening means (not shown). Each end plate 14,16 preferably includes a multiplicity of openings 22 for cooling and ventilation purposes, where the cooling may be supplied by either liquid or gaseous heat transfer media.

Figure 1:
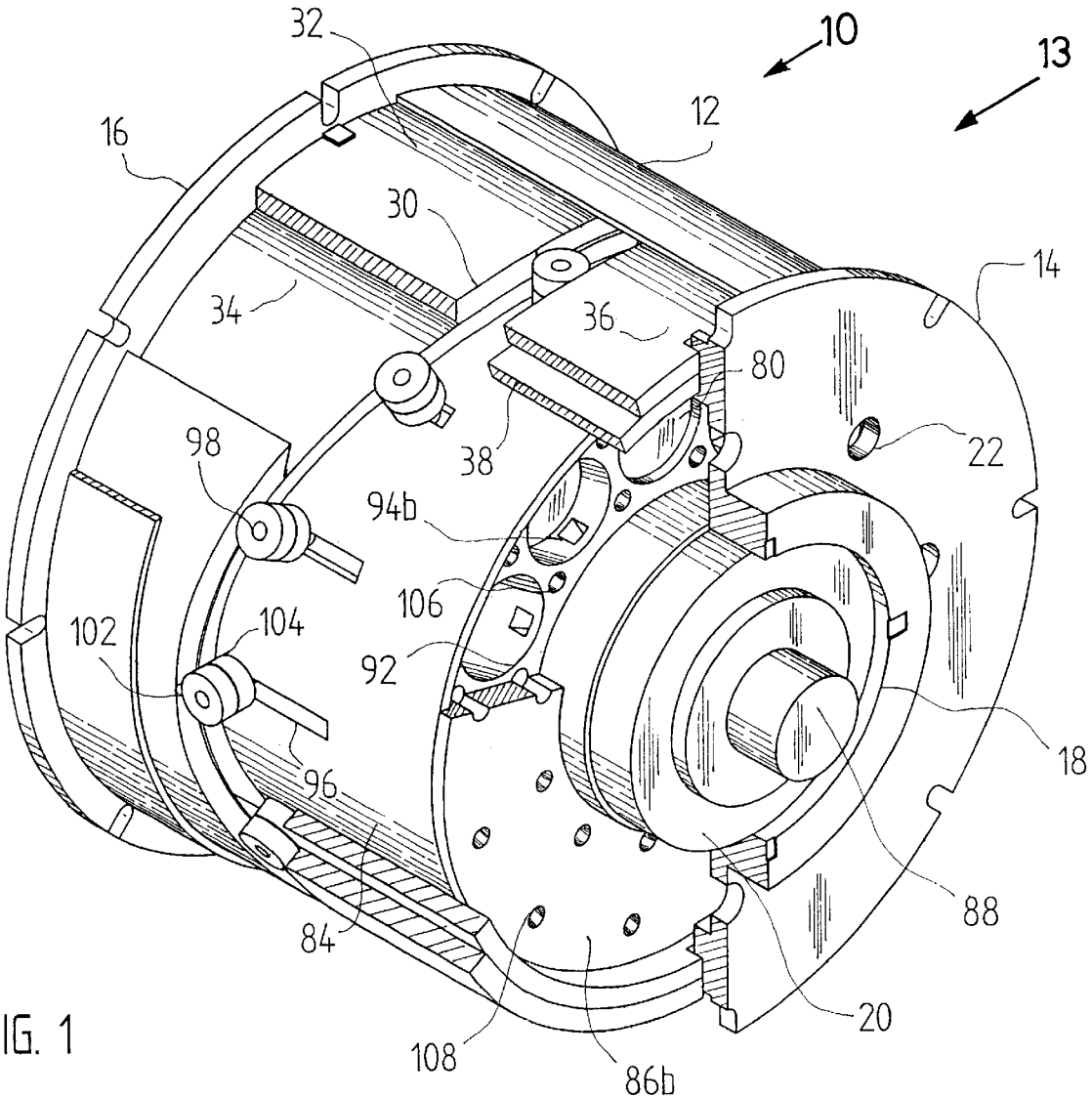
FIG. 1 is an isometric view of a four-stroke rotary power device having portions of the outer housing, cams, and rotor cut away for purposes of illustration.
Figure 2F:
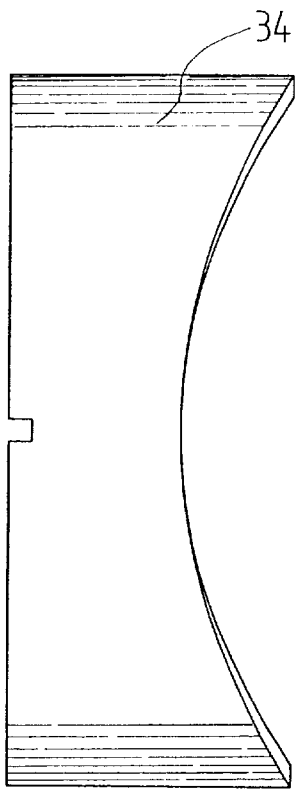
FIG. 2*f* is a side elevation view of the cam element of FIG. 2.
Figure 2:
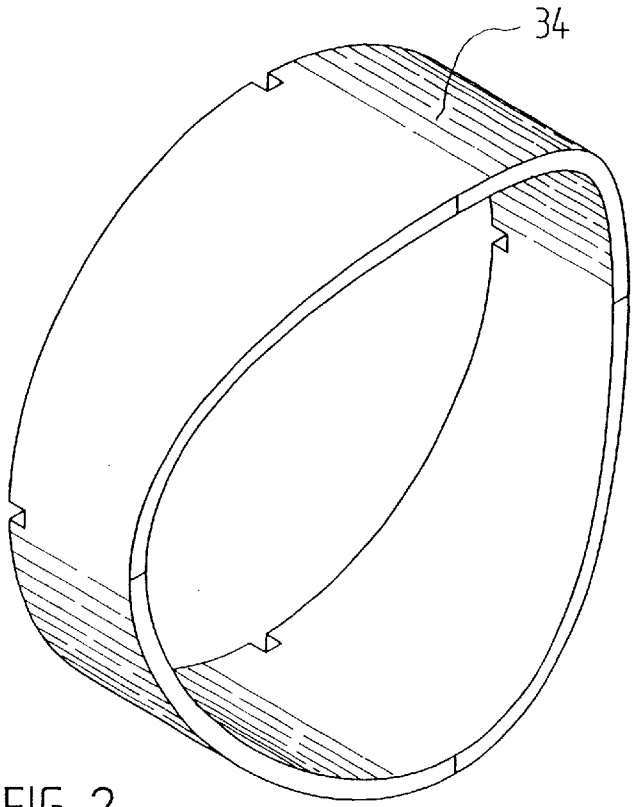
FIG. 2 is an isometric view of one cam element of a double-track cam assembly of the rotary device of FIG.1.
Figure 2A:
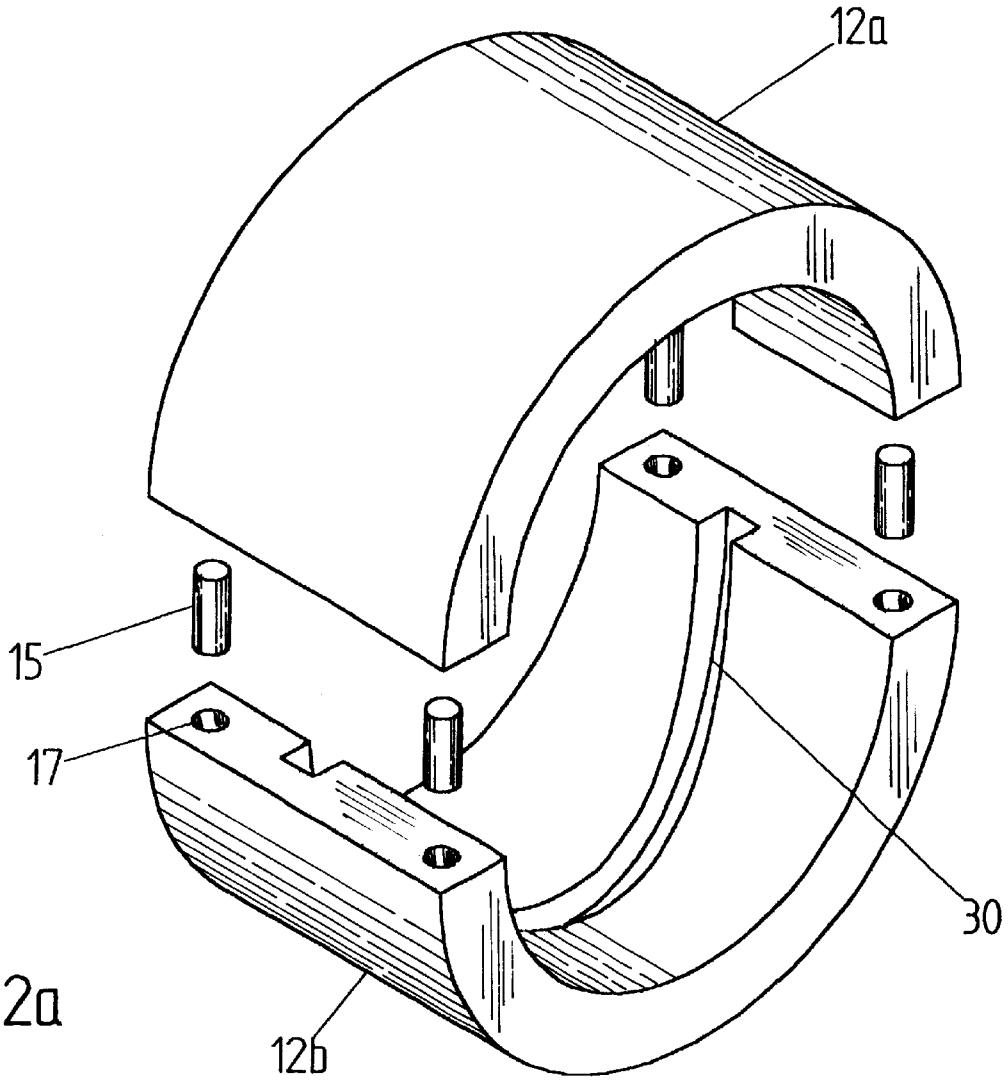
FIG. 2*a* is an exploded view of an alternate embodiment of a cam element wherein a cam track is incised into a stator portion.
Figure 3:
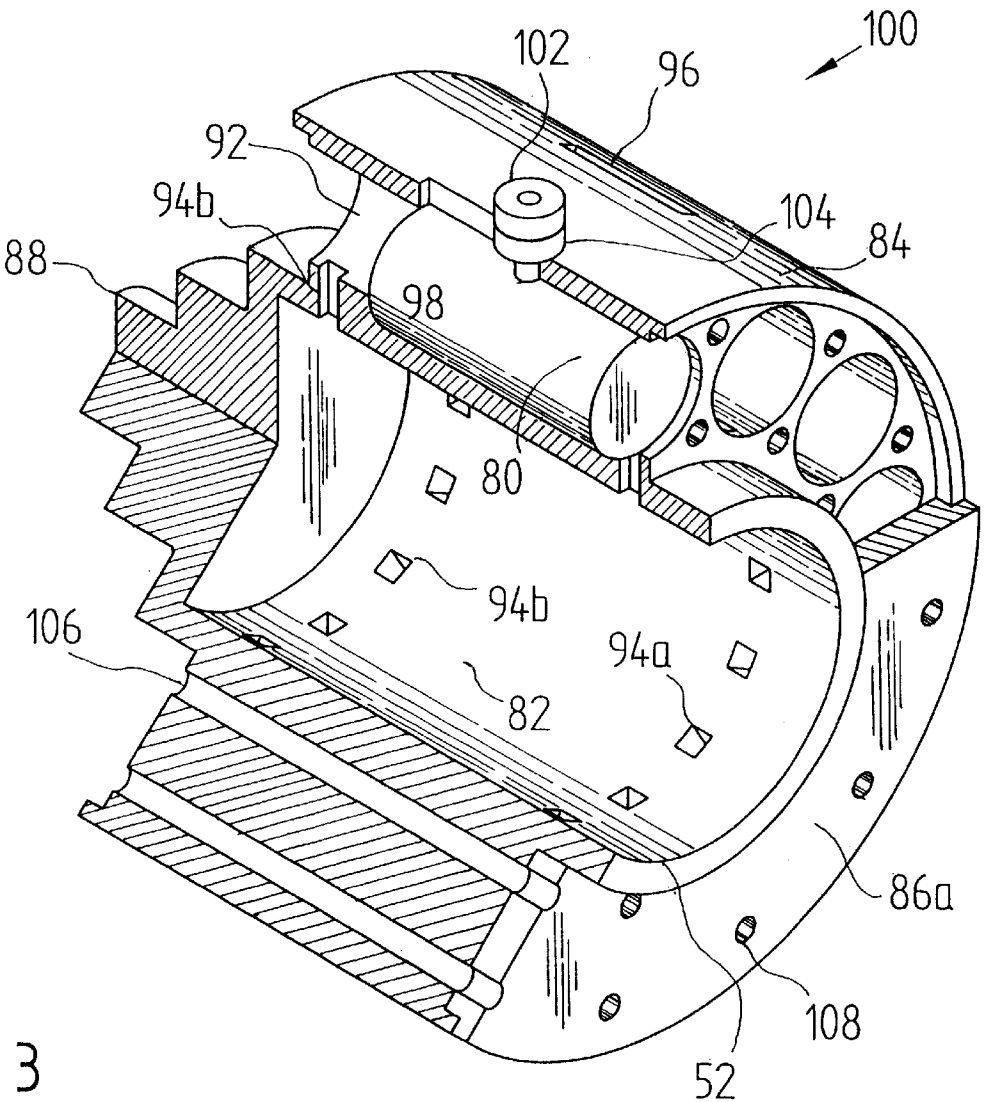
FIG. 3 is an isometric view of a cutout portion of the rotor-piston assembly for the four-stroke rotary power device of FIG. 1.
Figure 13F:
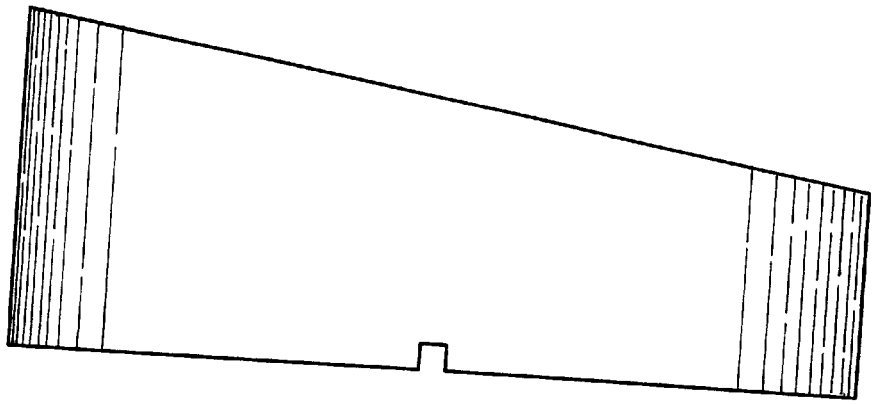
FIG. 13F is a side elevational view of the cam element of FIG. 13.
Figure 13:
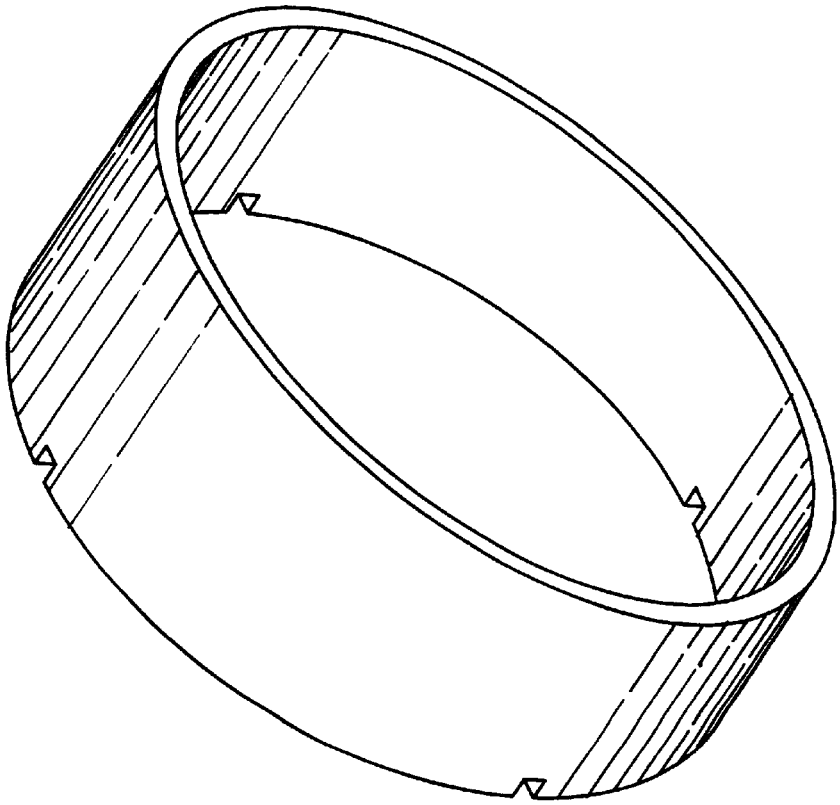
FIG. 13 is an isometric view of one cam element of a double-track cam assembly of the two-stroke rotary power device of FIG. 12.

A double-track cam 30 is disposed within the cylindrical housing 10 and preferably comprises a pair of outer mating elemental tracks 32, 36 enclosing another axially offset pair of inner mating elemental tracks 34, 38. Each elemental track, as shown in FIG. 2 and FIG. 13, is preferably formed from a cylindrical tubular element having an axially undulating guide track surface at one end. In a four stroke device the guide track surface comprises a first pair of points, at which the guide track surface is a maximum distance from the back end plate 16 and a second pair of points at which the guide track surface is a minimum distance from the back end plate 16. These minima and maxima are disposed in alternating fashion, as shown in FIG. 2. Correspondingly, in a two stroke device the guide track surface comprises exactly one maximum and exactly one minimum, as depicted in FIG. 13. In some preferred embodiments, the distance between the guide track and back plate may vary in a sinusoidal fashion comprising one or two sinusoidal cycles, for the two or four stroke device, respectively. Each tubular element is disposed in a fixed relationship to the external stator 10 and may be fixedly attached to one of the end plates 14,16, or alternatively may be fastened to the middle cylindrical housing portion 12, by bolts or other suitable fastening means (not shown). Alternatively, the cam track 30 may comprise a groove cut in the inner surface of the middle portion 12 of the stator, as depicted in FIG. 2*a*, in which the middle portion 12 comprises two mating halves 12*a*, 12*b* coupled by alignment rods 15 and holes 17.

Figure 4:
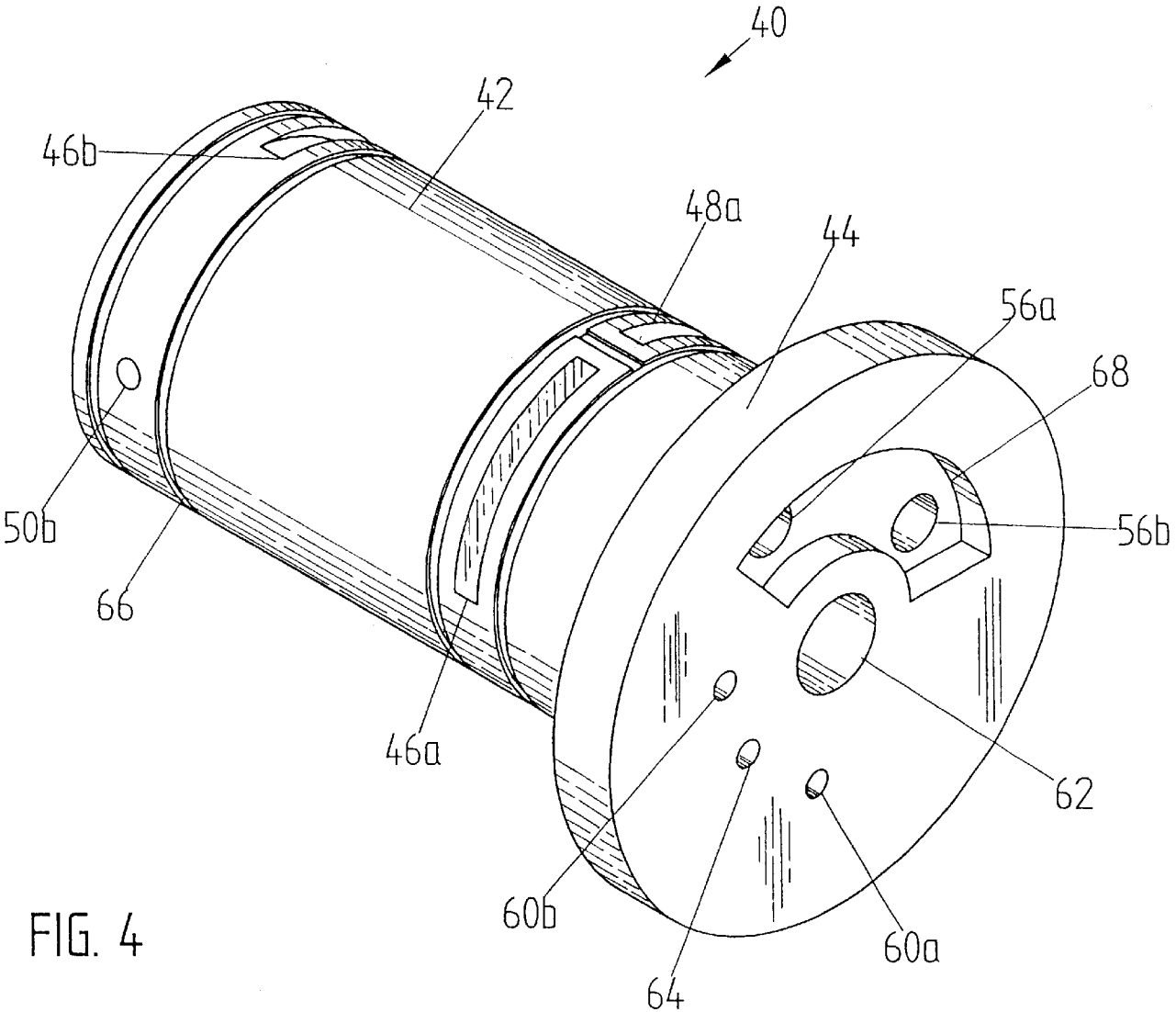
FIG. 4 is an isometric view of the central stator of the four-stroke rotary power device of FIG. 1.
Figure 4A:
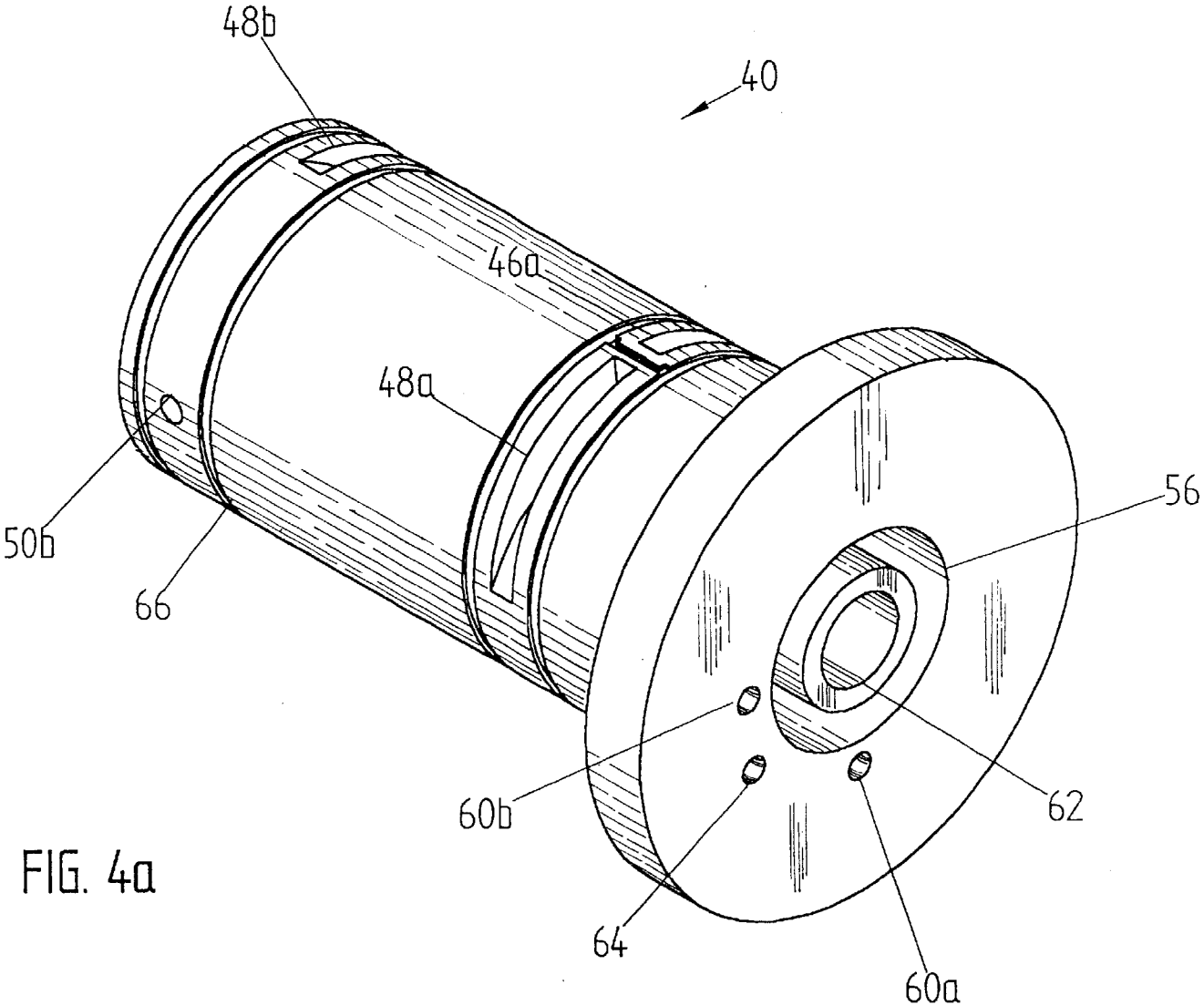
FIG. 4*a* is an isometric view of an alternative central stator of the four-stroke power device of FIG. 1.
Figure 4C:
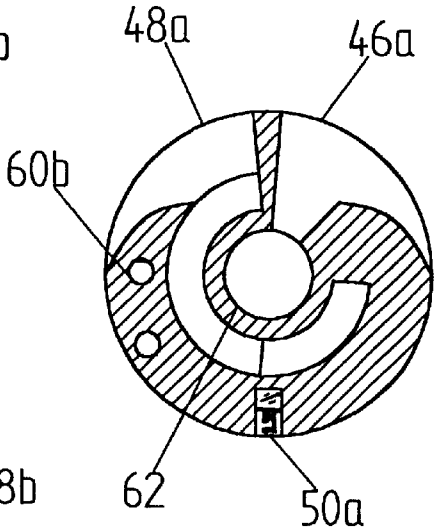
FIG. 4*c* is a sectional view taken along line 4*c*—4*c* of FIG. 4*f*.
Figure 4D:
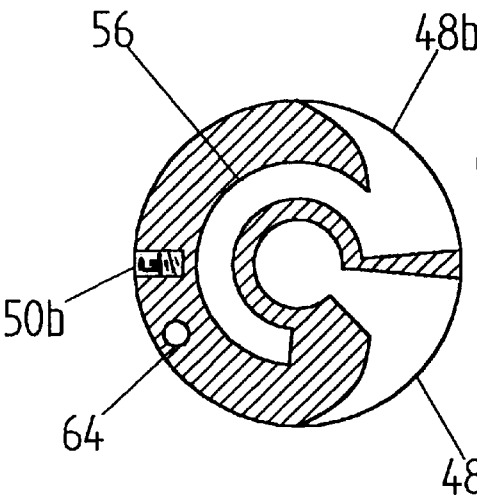
FIG. 4*d* is a sectional view taken along line 4*d*—4*d* of FIG. 4*f*.
Figure 4F:
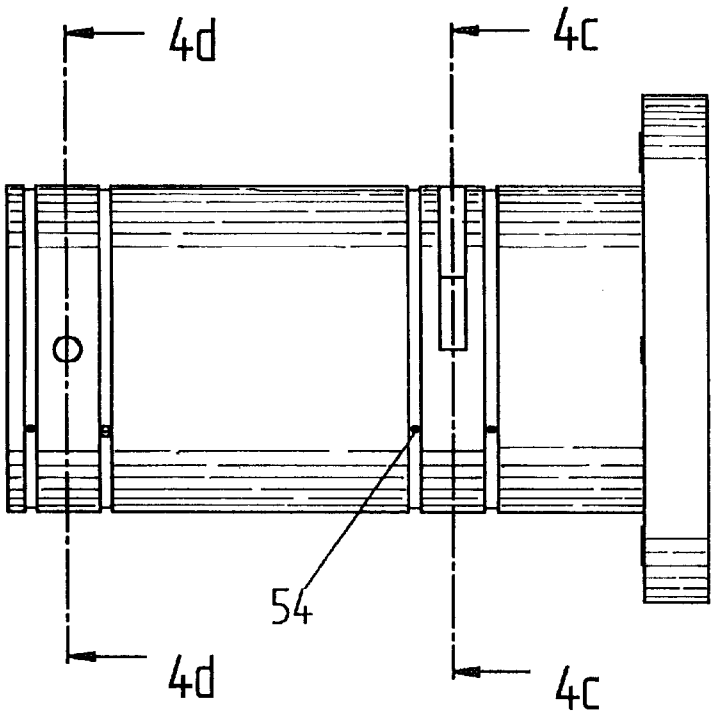
FIG. 4*f* is a side elevation view of the alternative central internal stator of FIG. 4*a*.
Figure 5:
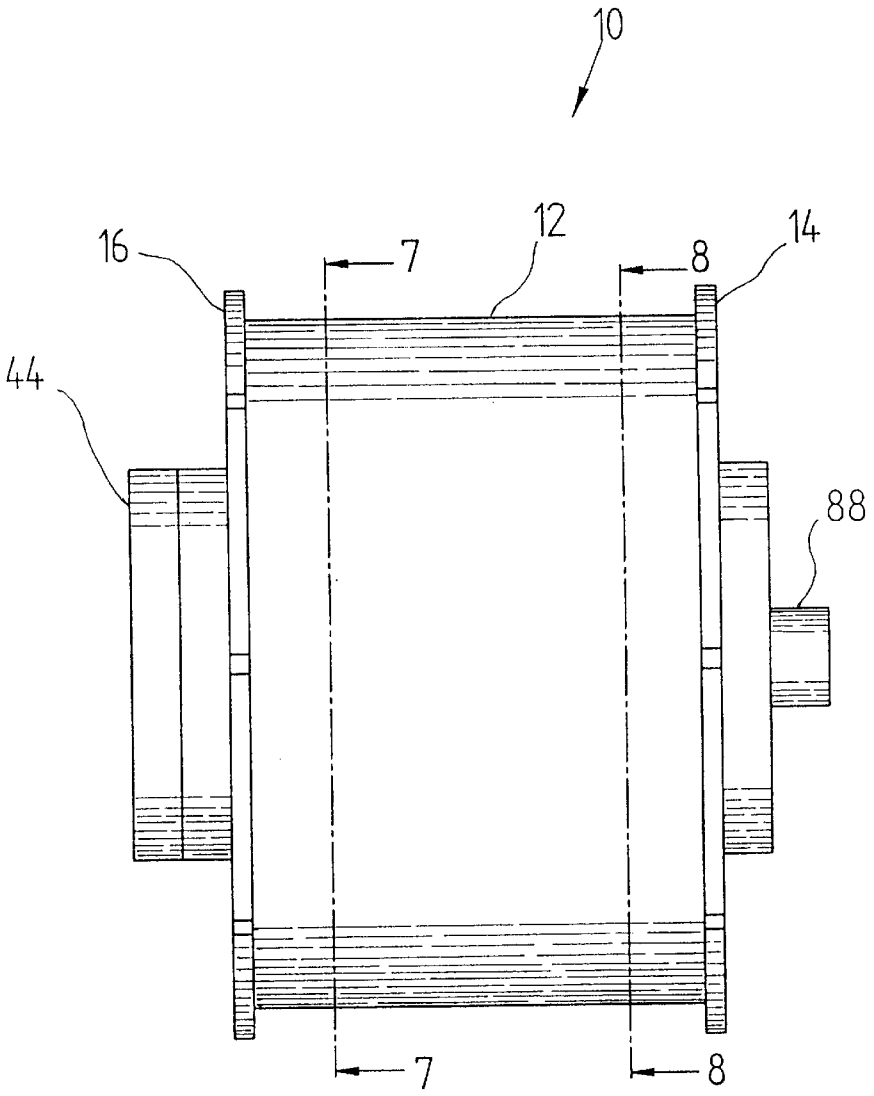
FIG. 5 is a side view of the rotary power device of FIG. 1.
Figure 6:
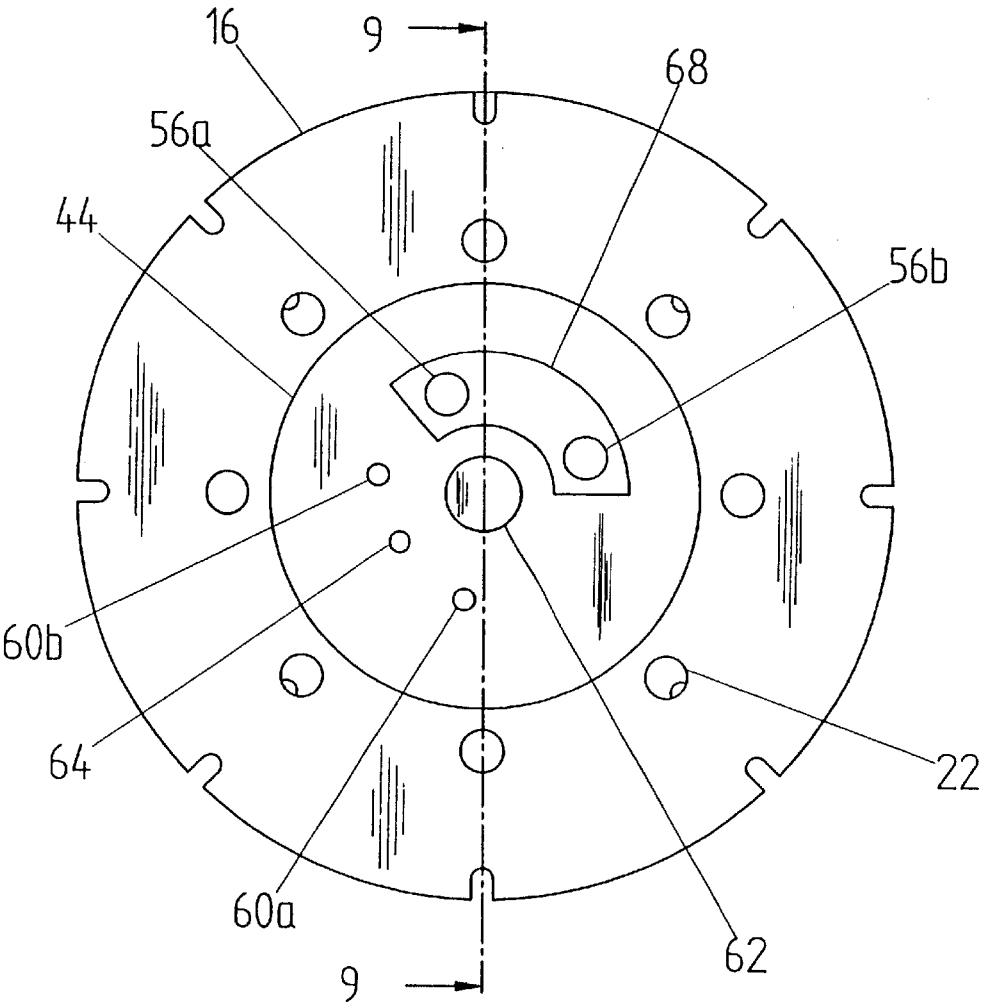
FIG. 6 is an end view of the four-stroke rotary power device of FIG.1.
Figure 7:
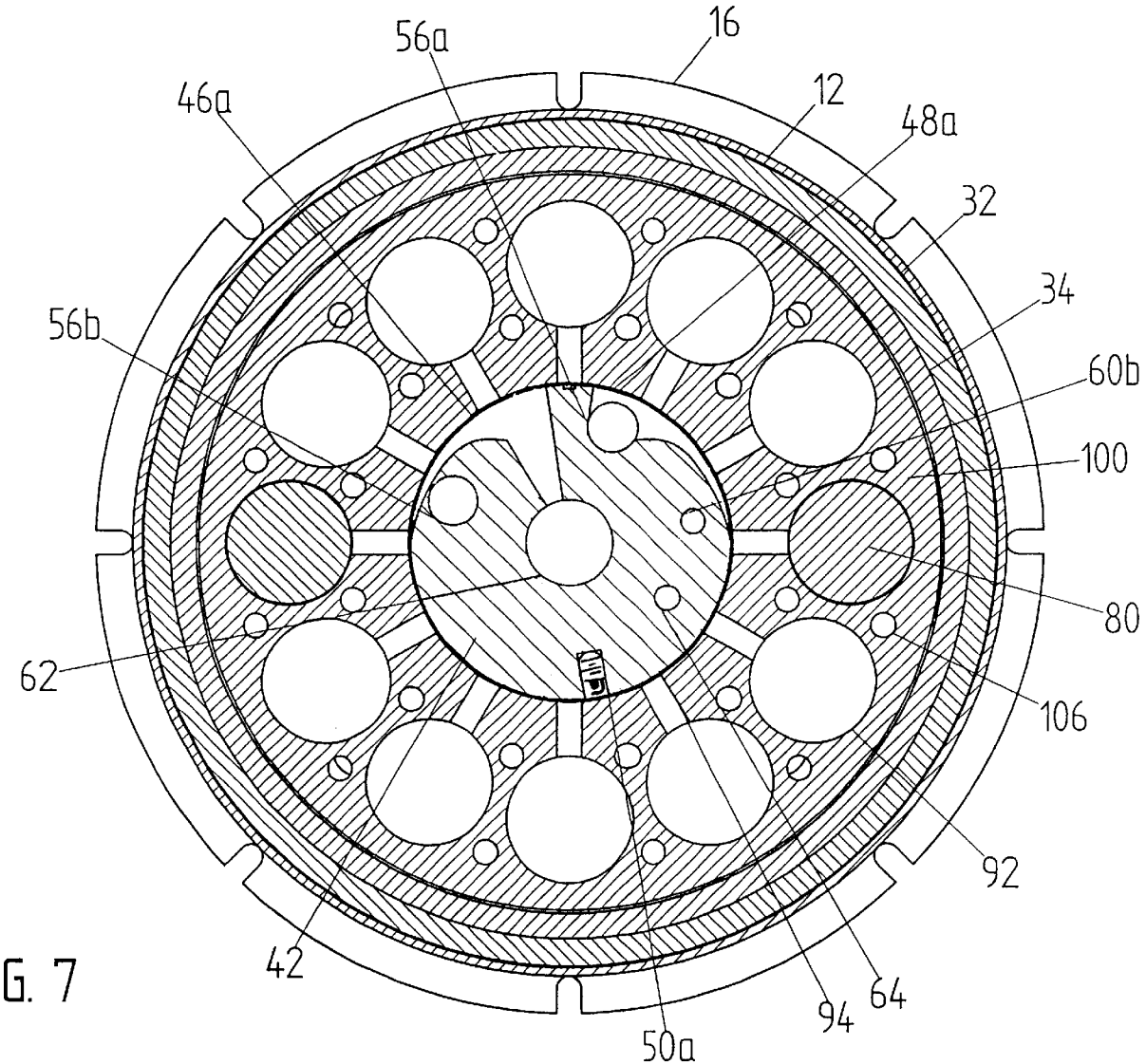
FIG. 7 is a sectional view taken along line 7—7 of FIG. 5.
Figure 8:
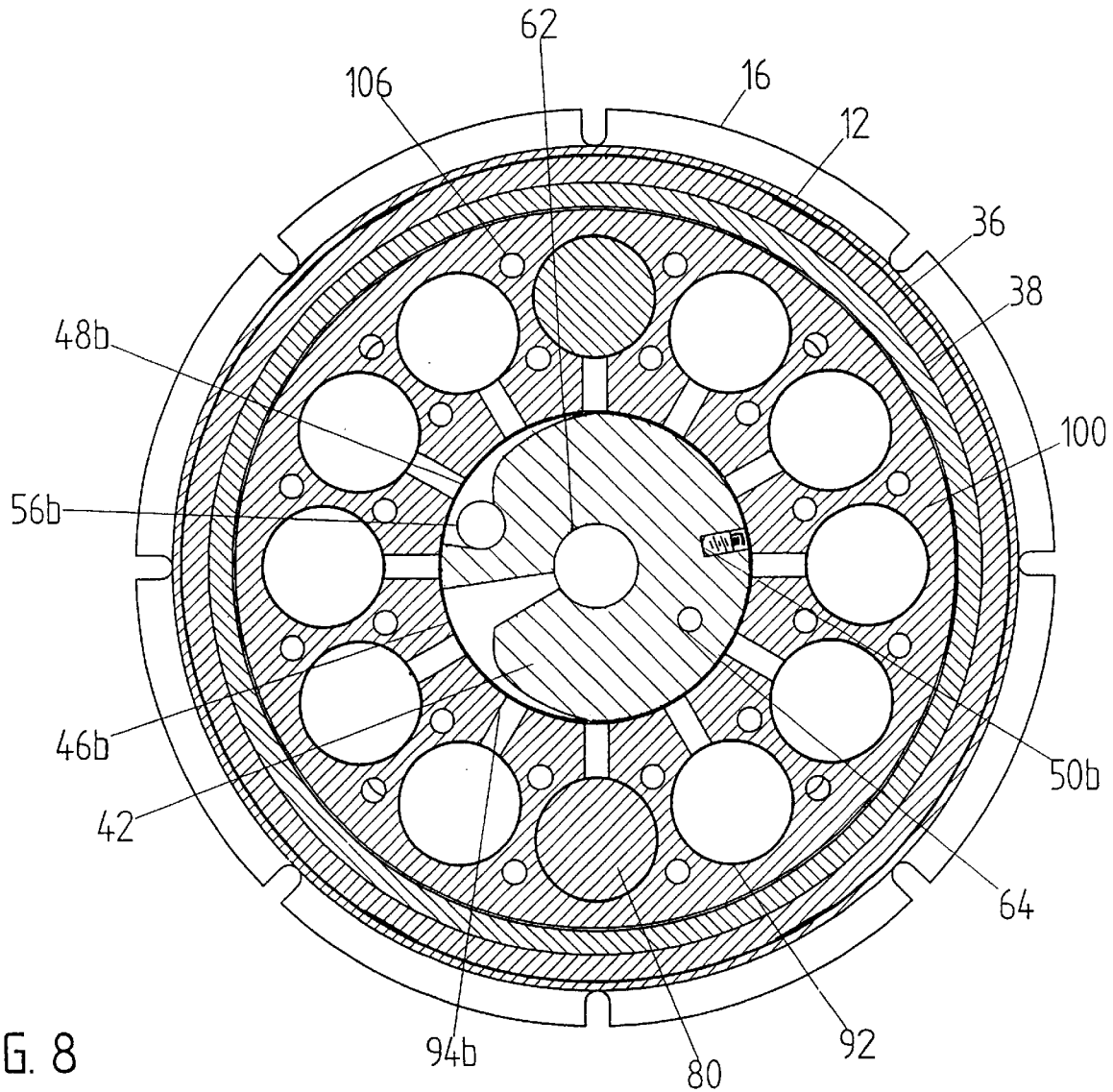
FIG. 8 is a sectional view taken along line 8—8 of FIG. 5.
Figure 9:
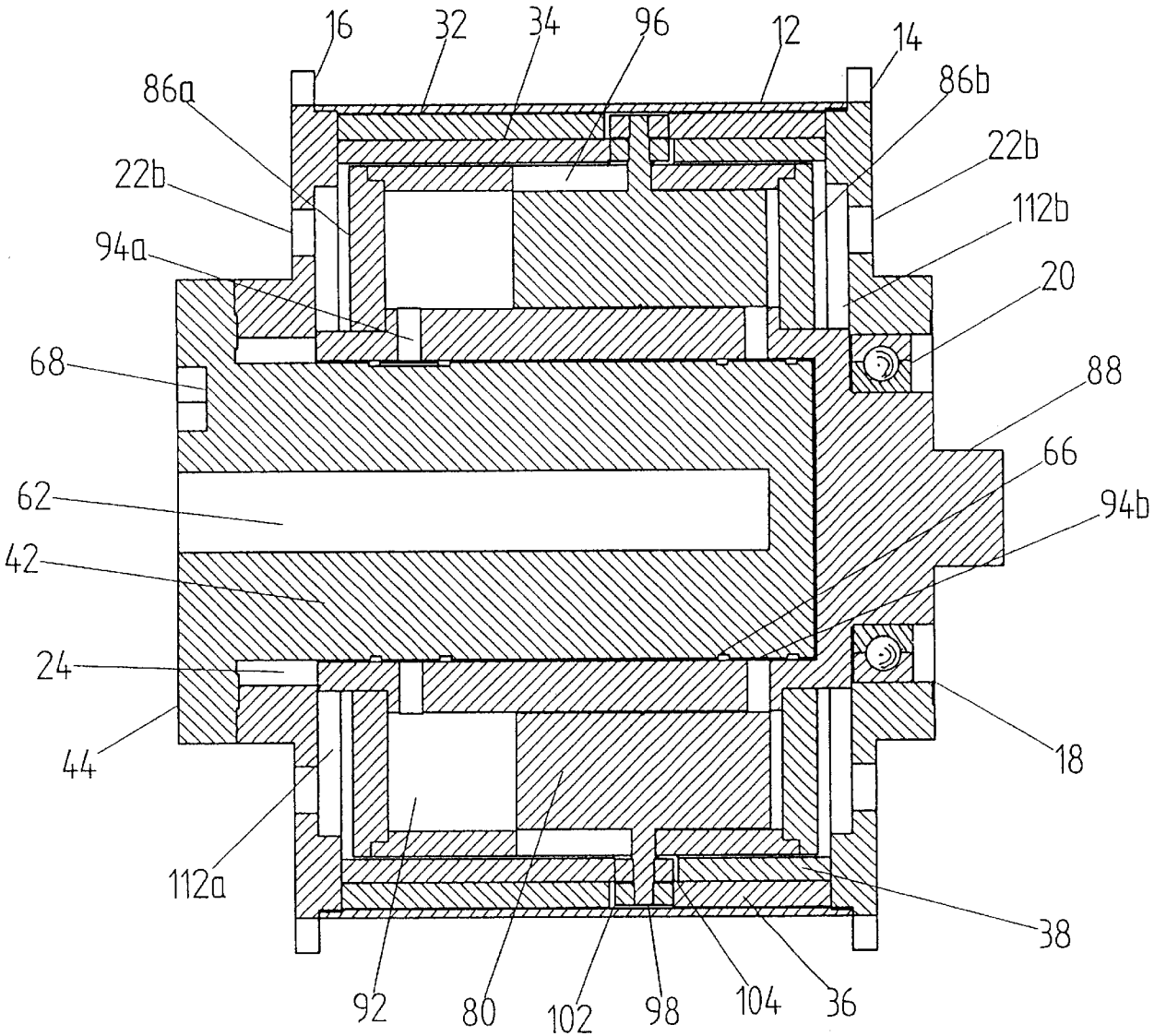
FIG. 9 is a side sectional view taken along line 9—9 of FIG. 6.

The central internal stator 40, as shown in FIG. 4, or alternately in FIG. 4*a*, comprises a cylindrical portion 42 extending coaxially through the interior, and an end flange portion 44 for fixedly attaching the stator to the end plate 16. Furthermore, the cylindrical portion 42 is provided with four lateral cutout openings forming one pair of angularly adjacent intake and discharge ports 46*a*, 48*a* that are axially spaced apart from a similar second pair of angularly adjacent intake and discharge ports 46*b*, 48*b*. The two pairs 46*a*, 48*a*; 46*b*, 48*b* are arranged to have a 90° angular phase shift relative to each other. Each port cutout opening is defined within an angular extension of approximately 90° and has an angularly varying radial depth profile. These lateral openings communicate with axial intake channels 62 and discharge channels 56*a*, 56*b*, or, alternately, with a combined discharge channel 56 used to connect these ports to the exterior as shown in FIGS. 4*f*, 4*c* and 4*d*. A first ignition port 50*a* is disposed approximately diametrically opposite to a corresponding angularly adjacent pair of intake and discharge ports 46*a*, 48*a*. A second, similar, ignition port 50*b* is disposed diametrically opposite to the intake and discharge ports 46*b*, 48*b*. These ignition ports 50*a* and 50*b* may be provided with electrical lead connections, spark plugs, etc. (not shown) by means of respective axial channels 60*a* and 60*b*. Recesses 66 may be provided in the cylindrical portion of the stator 42 to permit the inclusion of a spring biased ring seal (not shown) making a sliding contact with the inner wall of a rotor assembly 100. Lubrication of these seals may be provided through openings 54 in the recess communicating with the axial channel 64, which serves as an axial lubrication passageway adapted to supply lubricant fluid to the clearance space between the central stator portion and the block.

The rotor assembly 100 is disposed in the generally annular space formed between the stator 40 and the inner wall of the double-track cam 30. This assembly 100 comprises a cylindrical block 84 having a multiplicity of axially oriented working cylindrical bores 92. Each of the working cylinders 92 is parallel to and preferably equidistant from the axis 89 of the device and the working cylinders are spaced at equal angular intervals surrounding the central bore 52. The rotor assembly 100 includes an axial shaft 88 fixedly attached to one end of the cylindrical block 84 and rotatably journaled within a bearing means 20 in one end plate 14. The shaft 88 extends outwardly through the end plate opening 18 for transmitting output shaft power in versions of the rotary power device that are configured as engines and for receiving an input torque in versions of the rotary power device that are configured as pumps or compressors. In the example depicted in the drawing, there are twelve working bores 92 which are disposed parallel to each other and to the axis of rotation of the shaft 88. Each working bore is closed at both ends, preferably by cover ring plates, 86*a*, 86*b*, which may be fixedly secured to the rotor cylindrical block 84 by bolts or other suitable attachment means (not shown). Each working cylinder 92 bore has two axially spaced apart end openings 94*a*, 94*b* disposed adjacent respective ends of the bore and radially inwardly communicating with the central bore 52. Each cylinder bore also includes a respective medially disposed elongated cam follower slot 96 extending outwardly through the outer wall of the rotor block 84. A reciprocating piston 80 is slidingly disposed in each bore element 92. A medially projecting pin 98 attached to each piston extends through the respective cam follower slot 96. The projecting pin 98 is preferably journaled into two cam followers 102 and 104, where each cam follower comprises a roller or a bearing adapted to engage one single track element of the double-track cam 30. In the present illustration, the outer cam follower 102 engages the outer cam track element 36, and the inner cam follower 104 engages the inner cam track element 34. One advantage of using the double track cam assembly is to reduce noise and vibration of the engine while providing sufficient clearance for lubrication of roller elements.

An understanding of the operation of the rotary power device 13 of the invention as a four-stroke internal combustion engine may be gained by reference to the depiction of FIGS. 7–10*b*. This engine may be started by means of a starter motor (not shown) temporarily connected to the shaft 88 to initiate the rotation of the rotor assembly 100. As the pressure forces exerted on pistons is transmitted through their cam followers exerting contact forces on the cam track, the tangential components of the reaction forces of said contact forces cooperate to develop a torque causing the rotation of the rotor assembly. At the same time, the pistons 80 reciprocate in their respective cylinder elements 92 as the corresponding cam followers 102, 104 engage the double-track cam 30. A step-by-step analysis of the process may begin with by recourse to a limiting position in which one end of the cylinder bore portion bounded by one piston head and end cover plate 86*b* is at its minimum operating volume.

This corresponds to the so called top dead center (tdc) in a conventional engine. As the piston element starts moving away from the end wall 86*b* it uncovers end opening 94*b* in the cylinder, and an air/fuel mixture charge is drawn into the cylinder portion from the intake port 46*b* in the internal stator 40 while the rotor assembly 100 completes the first 90° of its angular displacement, at which point the volume reaches a maximum corresponding to the first bottom dead center (bdc) position in a conventional engine. During the second 90° angular displacement of the rotor assembly, the piston 80 starts moving back toward the end wall 86*b* while the end opening 94*b* is blocked by the wall 42 of the internal stator 40, thereby compressing the air/fuel mixture to a minimum volume corresponding to the second (tdc) position. At the beginning of the third 90° angular displacement of the rotor assembly, a different opening 94*b* of the cylinder element aligns itself with the ignition passageway 50*b* so that a spark can initiate combustion and power expansion. After the expansion the volume reaches its second maximum corresponding to the second (bdc) position in a conventional engine. During the fourth 90° angular displacement of the rotor assembly, opening 94*b* registers with the discharge port 48*b* as the piston 80 moves toward the end wall 86*b*, thereby discharging combustion products as the piston moves towards its second (tdc). The other end of the piston 80 performs identical cycle phases but with a 90° phase shift. For example, as one end of the cylinder bore performs an intake stroke the other end performs a compression stroke. As illustrated in FIG. 10, the present rotary engine comprises twelve cylinder elements 92 performing in one revolution of the rotor assembly the equivalent of twenty-four cylinders in two revolutions of the conventional four-stroke spark ignition engine.

The rotary power device may be cooled by forcing cooling fluid through the set of openings 22 at one end plate 14 and discharging the heated cooling fluid through the opposed set of openings 22 in the other end plate 16. Within the interior space, cooling fluid may be transmitted from one end interior space 112*a* through openings 108 and axial channels 106 of the rotor assembly to the opposing end interior space 112*b*.

Figure 11F:
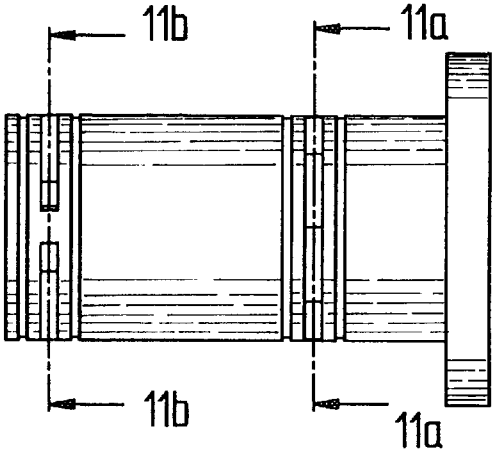
FIG. 11*f* is a side view of FIG. 11.
Figure 11B:
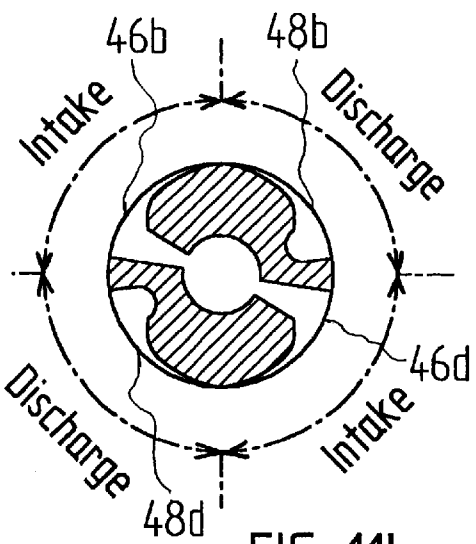
FIG. 11*b* is a sectional view taken along line 11*b*—11*b* of FIG. 11*f*.
Figure 11A:
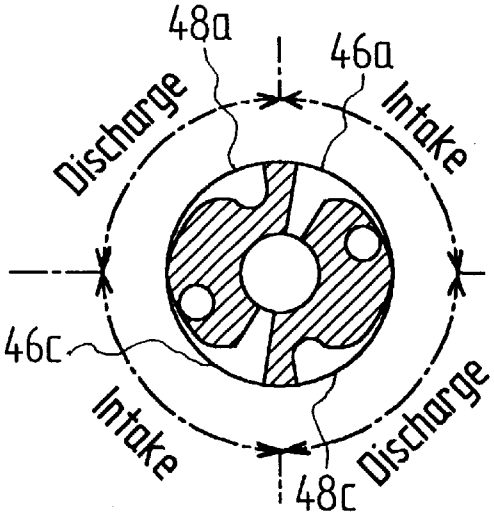
FIG. 11*a* is a sectional view taken along line 11*a*—11*a* of FIG. 11*f*.
Figure 11C:
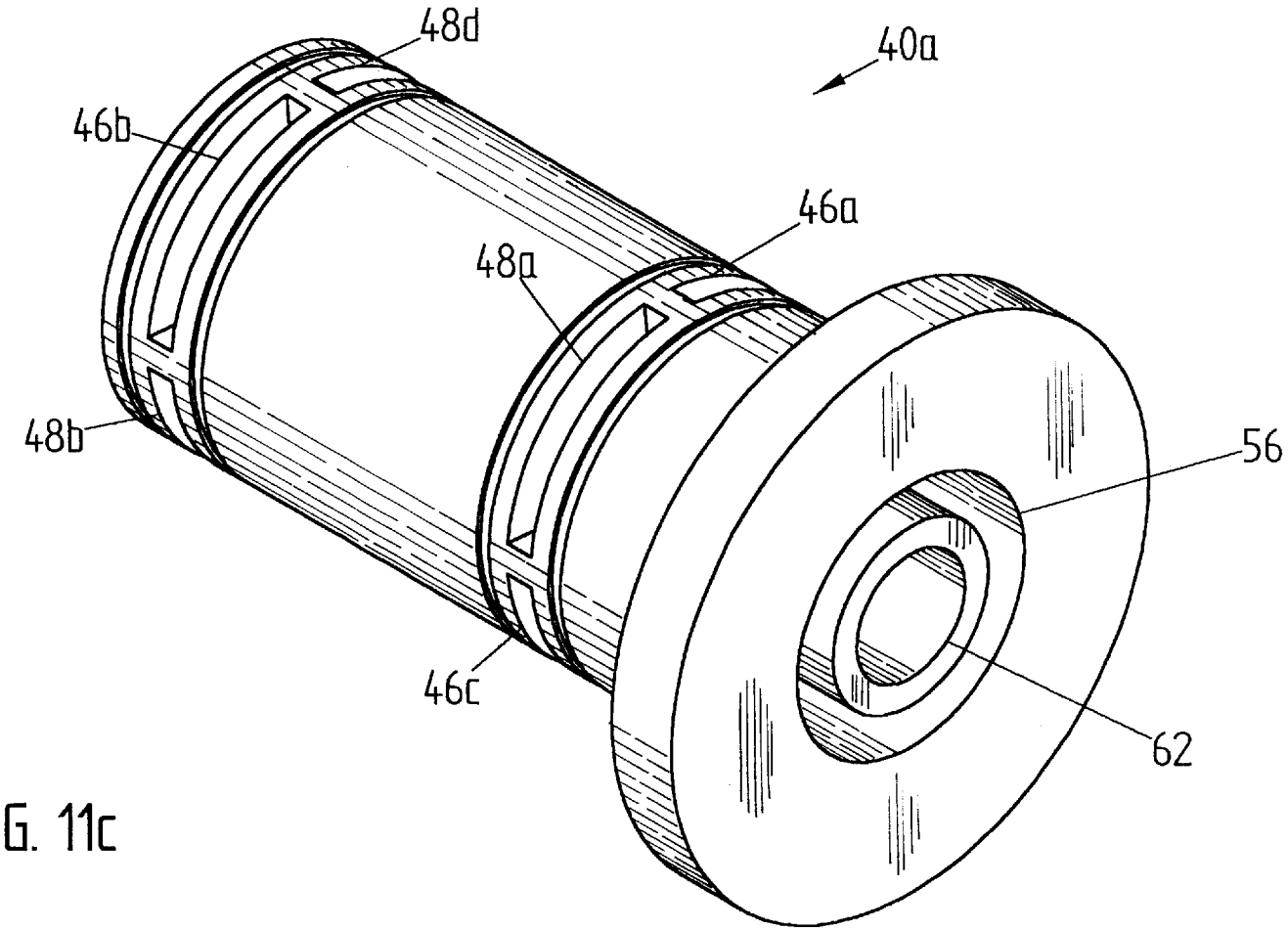
FIG. 11*c* is an isometric view of an alternative central stator of the power device operating as a four-stroke pump, compressor, fluid-driven motor or expander device.
Figure 11H:
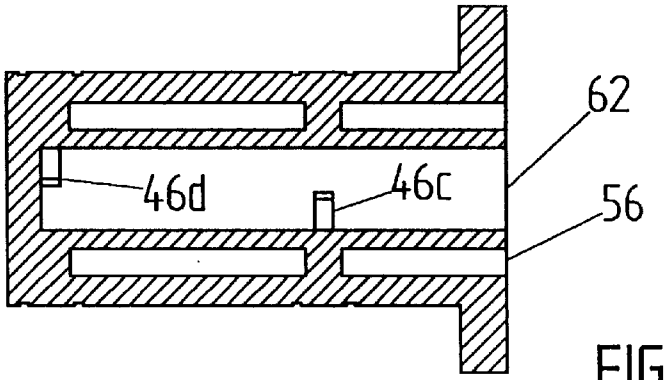
FIG. 11*h* is a sectional view taken along line 11*h*—11*h* of FIG. 11*d*.
Figure 11E:
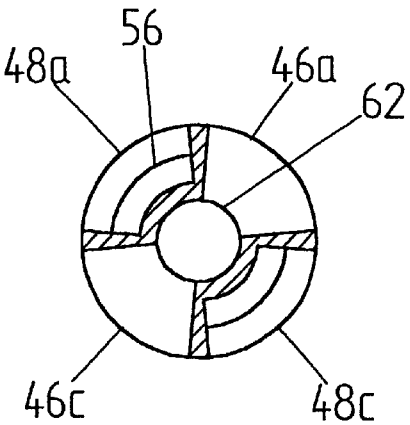
FIG. 11*e* is a sectional view taken along line 11*e*—11*e* of FIG. 11*d*.
Figure 11G:
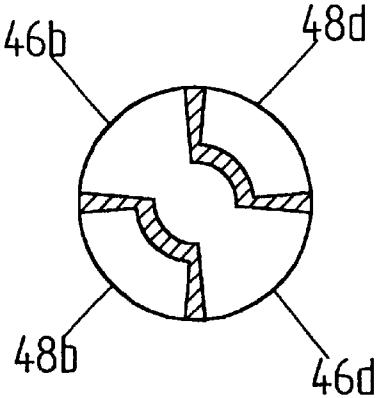
FIG. 11*g* is a sectional view taken along line 11*g*—11*g* of FIG. 11*d*.
Figure 11D:
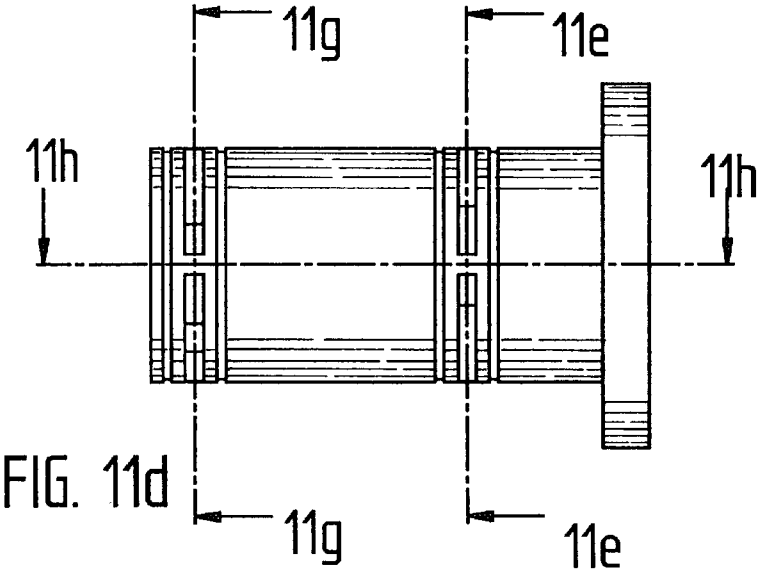
FIG. 11*d* is a side view of the alternative central internal stator of FIG. 11*c*.
Figure 12:
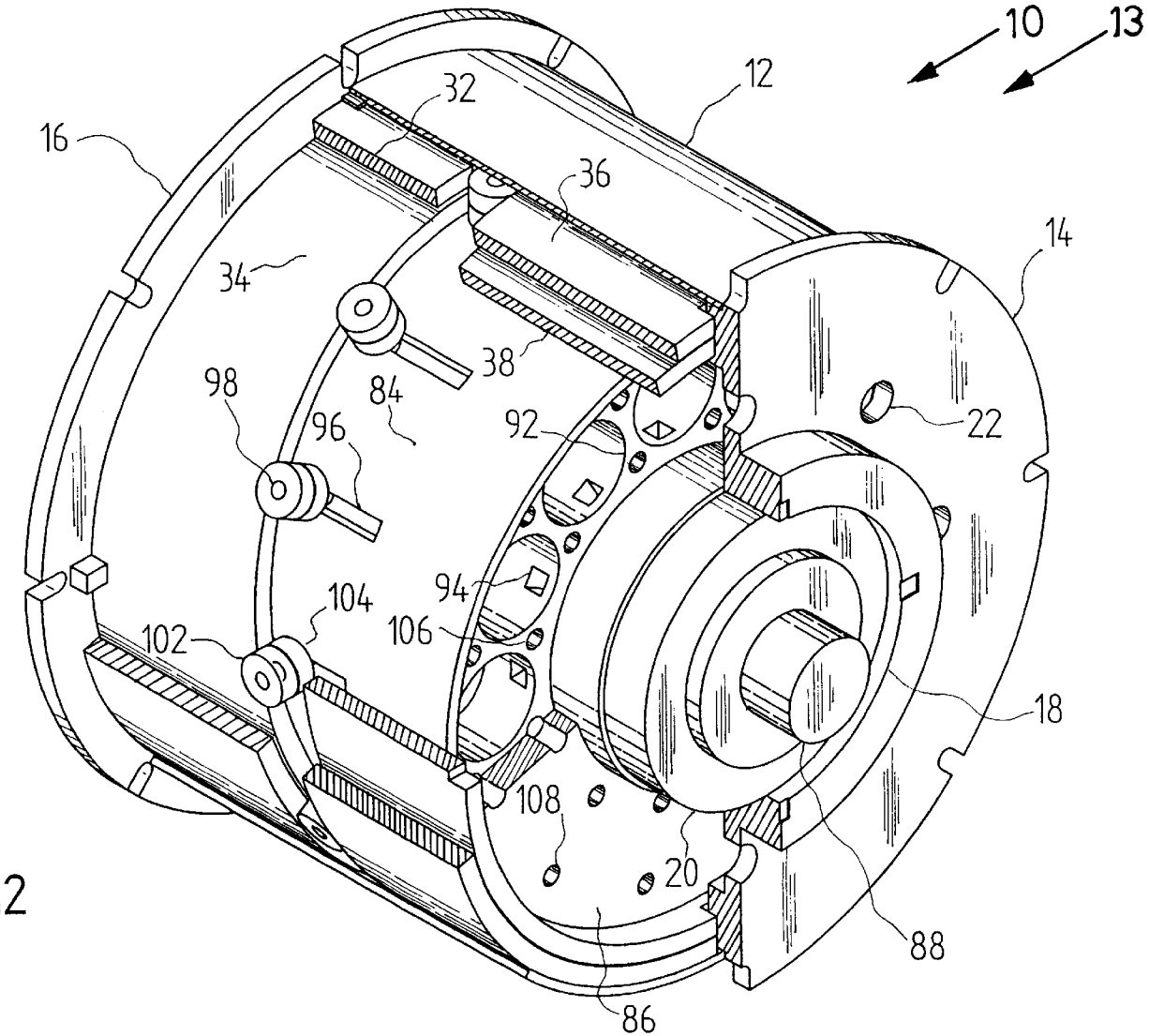
FIG. 12 is an isometric view of a two-stroke rotary power device having portions of the outer housing, cams, and rotor cut away for purposes of illustration.

The rotary power device can be easily converted to serve a different purpose other than the internal combustion engine by replacing the internal stator 40 as shown in FIG. 11 or alternately as shown in FIG. 11*c*. Referring to FIGS. 11–11*f*, a rotary power device employing a modified central stator 40*a* can function as any one of a motor-driven compressor or pump, a fluid-driven pump or compressor, a fluid-driven motor, and an expander device. In this configuration, the central stator comprises two sets of intake and discharge ports, where each set is defined in one plane transverse to the axis 88 and axially spaced apart from a second plane that includes the second set. Moreover, each set is in alignment with corresponding openings 94 in the rotor assembly. Each set thus comprises two diagonally opposed intake ports alternated by another two diagonally opposed discharge ports. Each set is angularly displaced by 90° with respect to the other set. Each port of the intake and discharge ports in a selected plane transverse to the axis of rotation is defined within approximately a 90° angular displacement The four intake ports 46*a*, 46*b*, 46*c*, 46*d* communicate with a common central axial intake conduit 62, while the four discharge ports 48*a*, 48*b*, 48*c*, 48*d* communicate with separate corresponding axial channels 56*a*, 56*b*, 56*c*, 56*d* or alternately, with a common annular channel 56 of FIGS. 11*c*, 11*e*, 11*g*, and 11*h*. An alternative arrangement (not shown) is possible in which the discharge ports communicate with a central common axial exhaust conduit 62 and the intake ports communicate with a corresponding annular axial conduit 56. The recess 68 in flange portion 44 of the central stator is provided so that the separate discharge or intake axial channels communicate with a common corresponding discharge or intake header.

In the operation of the device depicted in FIGS. 11–11*f*, as the rotor assembly completes one revolution, each piston end performs four strokes, which comprise two intake strokes alternated by two discharge strokes. As one end of one piston performs an intake stroke, the other end of the same piston performs a discharge stroke. In functioning as a motor-driven pump or compressor, the rotor assembly is made to rotate by coupling the end shaft to a driving means such as a motor (not shown). The pistons reciprocate in response to the action of cam followers on the cam tracks, while openings 94 alternately register with intake and discharge ports in the stator 40*a*, thus performing intake and discharge functions. Alternately, the pump and compressor may be driven hydraulically or pneumatically by employing a driving fluid of higher pressure to communicate with one end of the bores, whereby the effect of the highly pressurized fluid is to pump or compress the fluid in the opposing end while, at the same time, imparting rotation of the rotor as a result of the action of the cam followers on the grooved cam track. In functioning as a fluid-driven motor or expander device, a pressurized fluid received in the axial intake channel 62 and subsequently routed to the operative ends of the bores 92 transmits an axial force through the piston 80 faces and respective cam followers 102 and 104 to the cam track 30 whose tangential component of the reaction imparts a torque on the rotor assembly, thus causing the rotation of the assembly and the reciprocation of pistons while discharging depressurized fluid during the discharge phase of the cycle.

Figure 14:
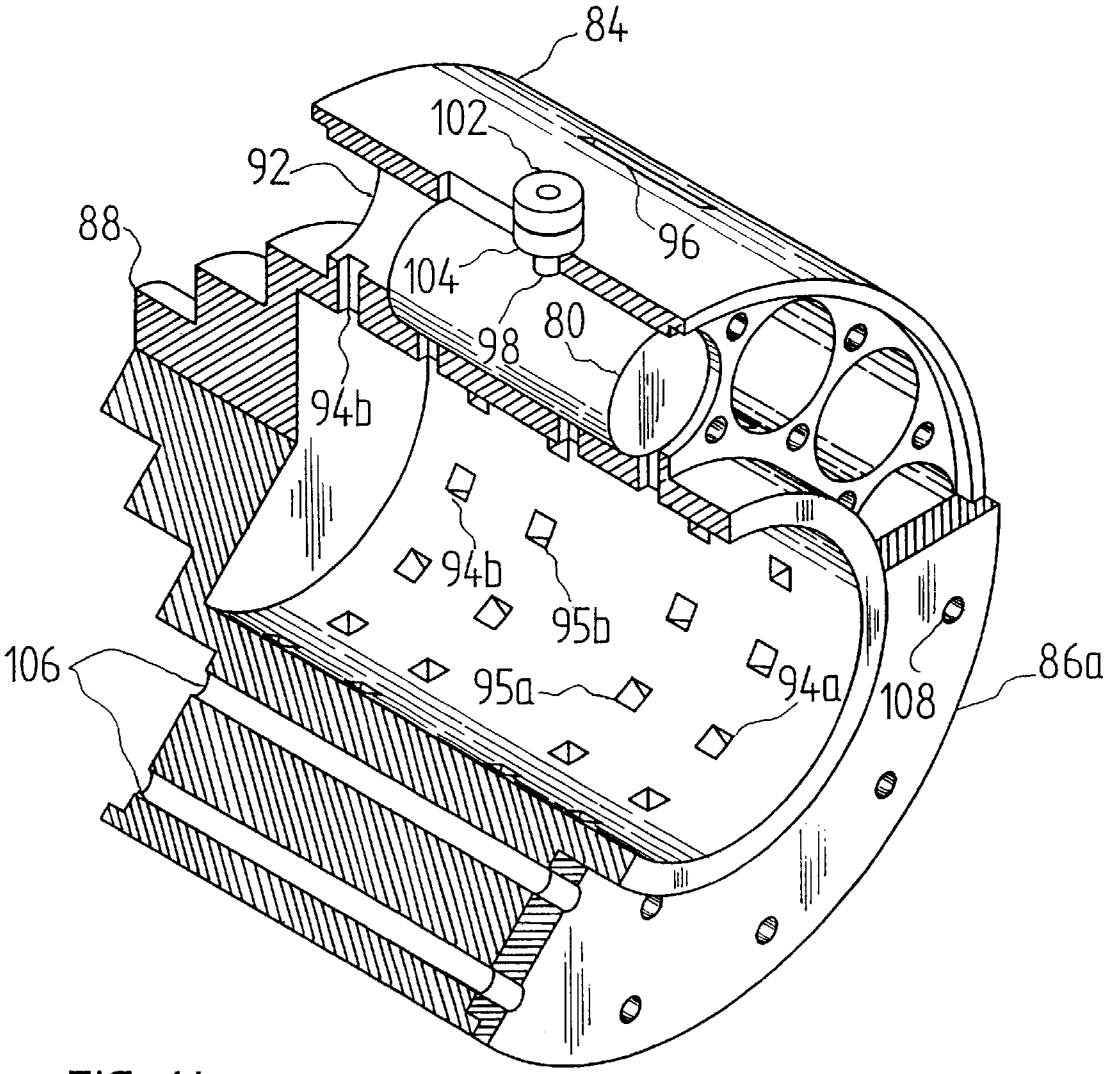
FIG. 14 is a cut-away view of a portion of the rotor-piston assembly for the two-stroke rotary power device of FIG. 12.

Turning now to FIGS. 12–18, one finds an embodiment of the invention that can operate as a two-stroke internal combustion engine. The transformation of the four-stroke to two-stroke rotary internal combustion includes the following modifications. First, the two-cycle cam track of FIG. 2 is replaced with a one cycle cam track, as depicted in FIG. 13. When the cam track of FIG. 13 is used, each piston performs two strokes when the rotary assembly moves through one revolution. Secondly, unlike the four-stroke rotary assembly case in which end openings 94*a* and 94*b* perform both intake and exhaust functions, the two stroke engine of FIGS. 12–18 comprises an additional pair of radially inward medial openings 95*a* and 95*b*, as depicted in FIG. 14. These medial openings 95*a*, 95*b* are used only for exhausting gases while the radially inward end openings 94*a* and 94*b* are used solely for intake. Thirdly, the internal central stator 40 is replaced with a modified central stator 40*c*.

Figure 15:
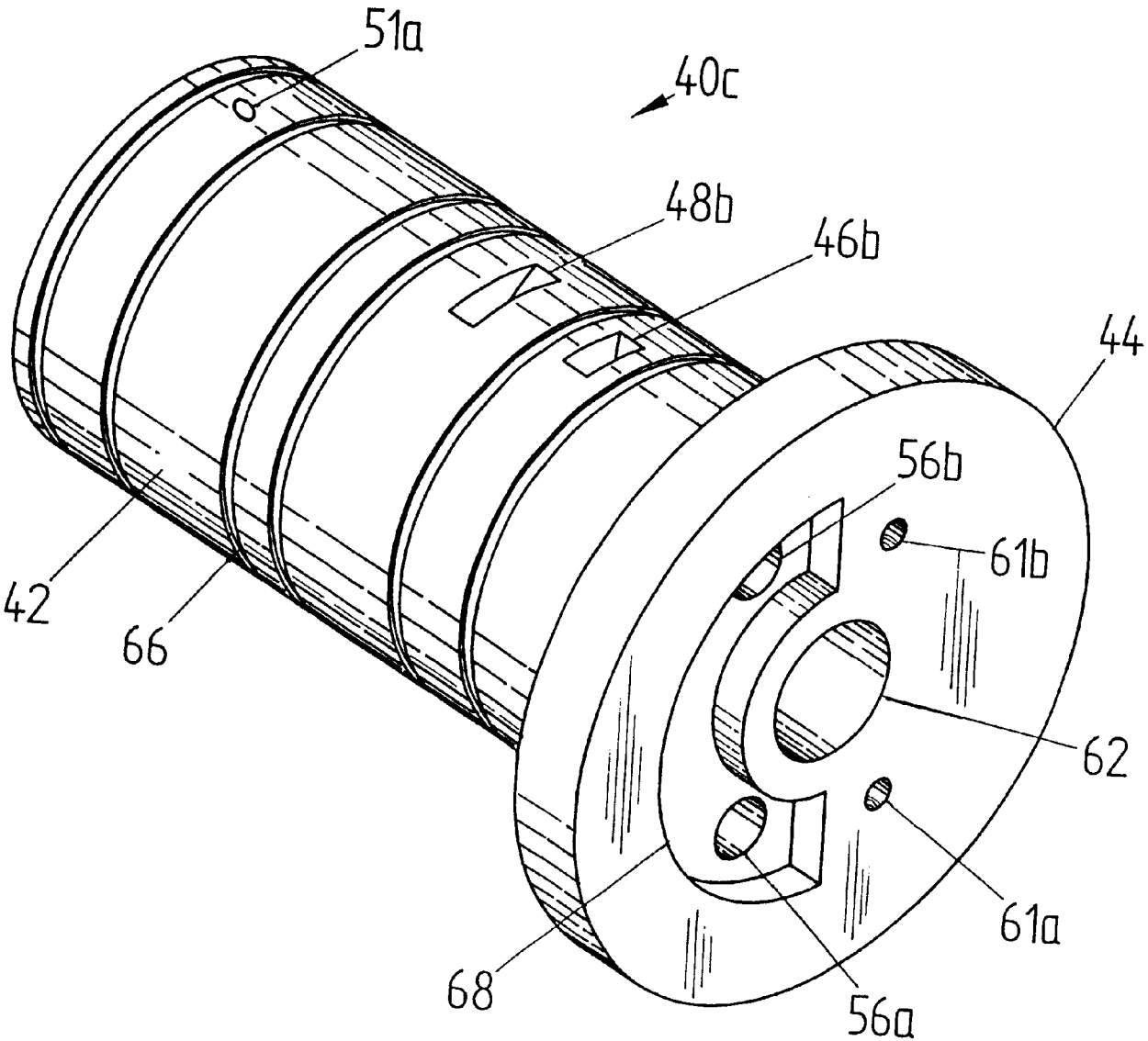
FIG. 15 is an isometric view of the internal stator of the two-stroke rotary power device of FIG. 12.
Figure 15A:
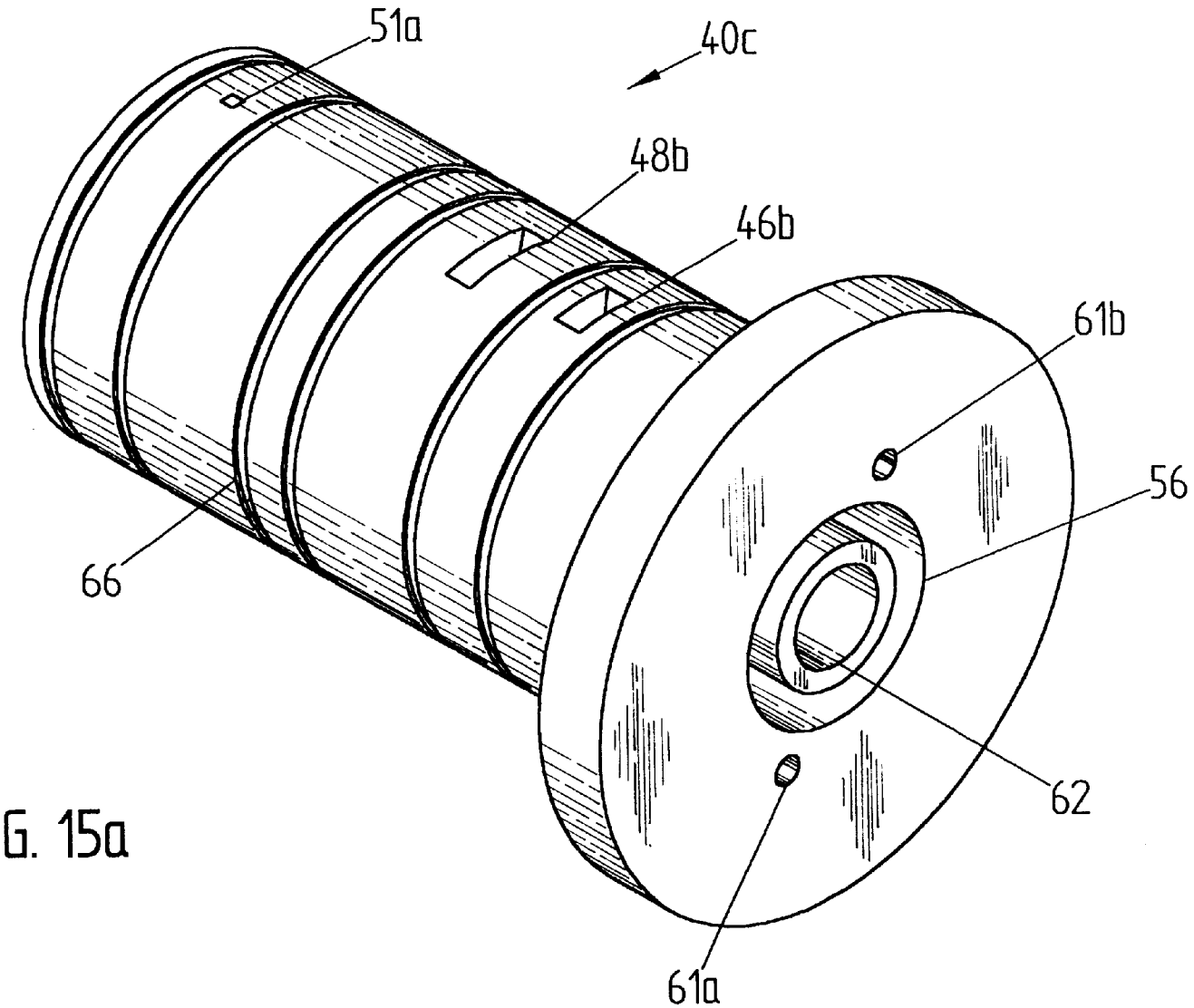
FIG. 15*a* is an isometric view of an alternative internal stator of the two-stroke rotary power device of FIG. 12.
Figure 15E:
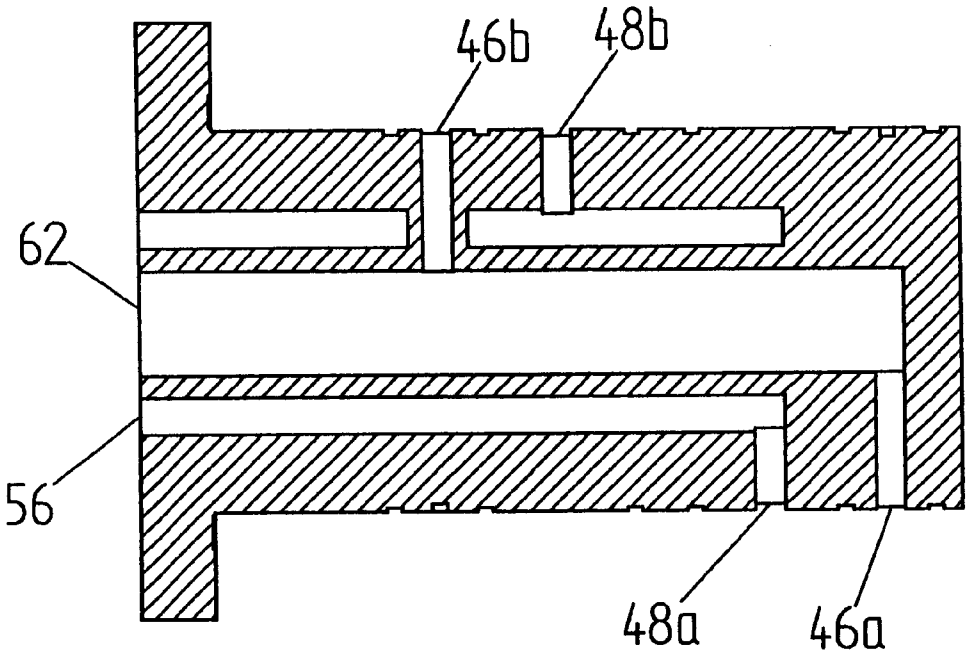
FIG. 15*e* is a sectional view taken along line 15*e*—15*e* of FIG. 15*d*.
Figure 15D:
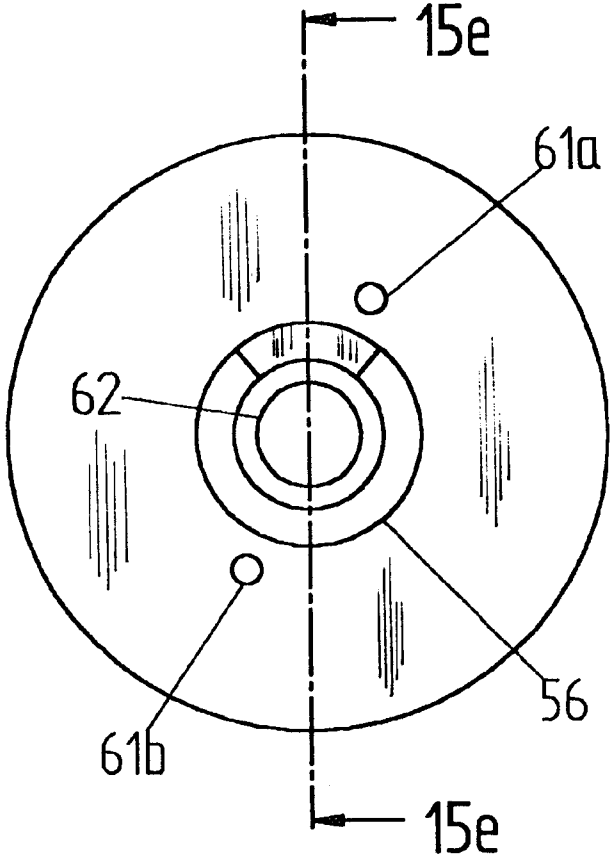
FIG. 15*d* is an end view of the alternative central internal stator of FIG. 15*a*.
Figure 16:
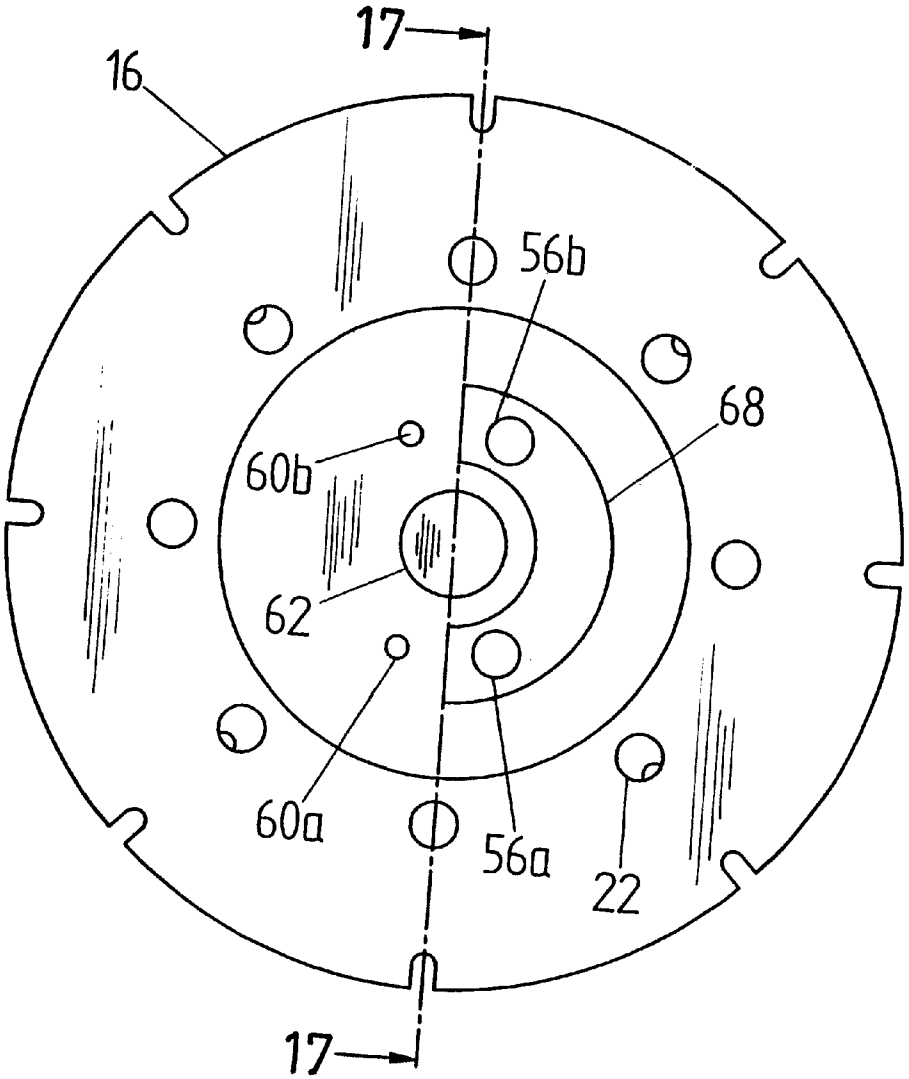
FIG. 16 an end view of the two-stroke rotary power device of FIG. 12.
Figure 17:
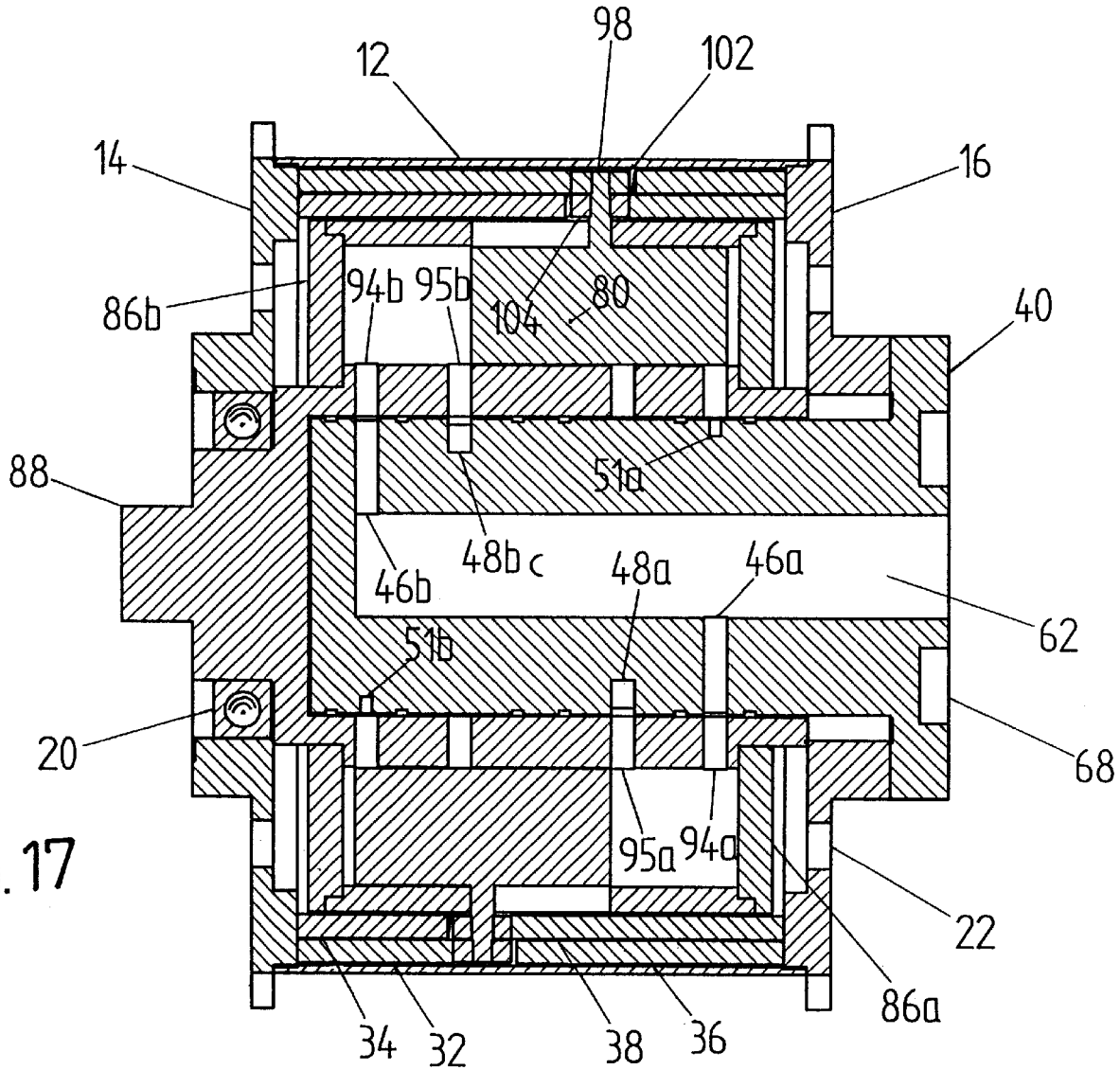
FIG. 17 is a side sectional view taken along line 17—17 of FIG. 16.
Figures 18, 18A, 18B, 18C, 18D:
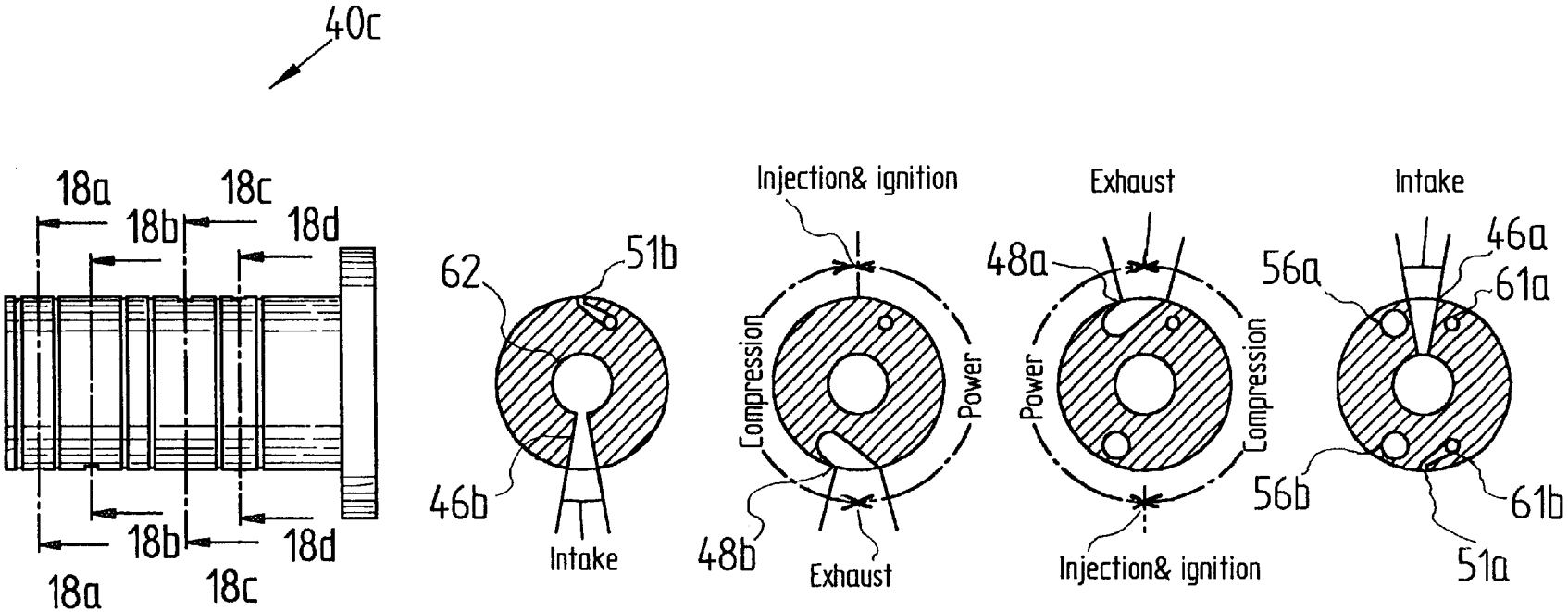
FIG. 18 is a side view of the internal stator of FIG. 15.
FIG. 18*a* is a sectional view of the internal stator of FIG. 18, the section taken as shown by 18*a*—18*a* in FIG. 18.
FIG. 18*b* is a sectional view of the internal stator of FIG. 18, the section taken as shown by 18*b*—18*b* in FIG. 18.
FIG. 18*c* is a sectional view of the internal stator of FIG. 18, the section taken as shown by 18*c*—18*c* in FIG. 18.
FIG. 18*d* is a sectional view of the internal stator of FIG. 18, the section taken as shown by 18*d*—18*d* in FIG. 18.

The modified internal central stator 40*c* as shown in FIG. 15, or alternately, as shown in FIG. 15*a*, for a two-stroke engine is similar to the central stator portion 40 used in the four-stroke engine except for the disposition of the intake and exhaust ports. The intake and discharge ports of the two stroke stator are axially displaced with respect to each other within each cylindrical bore potion, so that the exhaust port has a wider angular displacement to allow for air scavenging. Secondly, the two pairs of intake and discharge ports are disposed at 180° relative to each other. In addition, the ignition devices 50*a* and 50*b* of the four-stroke engine are replaced with injection ports 51*a* and 51*b* in the two-stroke engine. As depicted, an injection port 51*a* is disposed diagonally opposite to an intake port 46*a*, and similarly injection port 51*b* is diagonally opposite to its associated intake port 46*b*. Axial channels are provided, as in the four-stroke engine, to connect these ports to the exterior. Intake ports 46*a* and 46*b* communicate with an axial channel 62 and exhaust ports 48*a* and 48*b* respectively communicate with separate axial channels 56*a* and 56*b*, or alternately, communicate with a common annular exhaust channel 56 as depicted in FIGS. 15*d*–15*e*. Axial channels 61*a* and 61*b* provide injection charges to injection devices 51*a* and 51*b*, respectively.

The principle of imparting torque on the rotor is the same as in the four-stroke case. The tangential components of contact forces between cam followers and the cam track provide a rotating moment to the rotor, causing the rotation of the rotor while pistons reciprocate in their respective cylinders. Because of the one-cycle cam track profile, each piston performs two strokes as the rotor moves through a single complete revolution. Each stroke of a piston comprises predominantly a compression stroke at one end and power stroke at the opposing end. The operation of two-stroke power device as an internal combustion engine is illustrated with respect to the internal stator 40*c* by means of FIGS. 18*a* through 18*d*. When one end of the working cylinder nears a minimum volume position injection and auto-ignition occur. At the same time the opposite end of the working cylinder is approaching its maximum volume position exhaust and intake air scavenging takes place. In the scavenging operation, the intake port overlaps with the exhaust port and causes air to replace the leftover products of combustion.

Figure 19C:
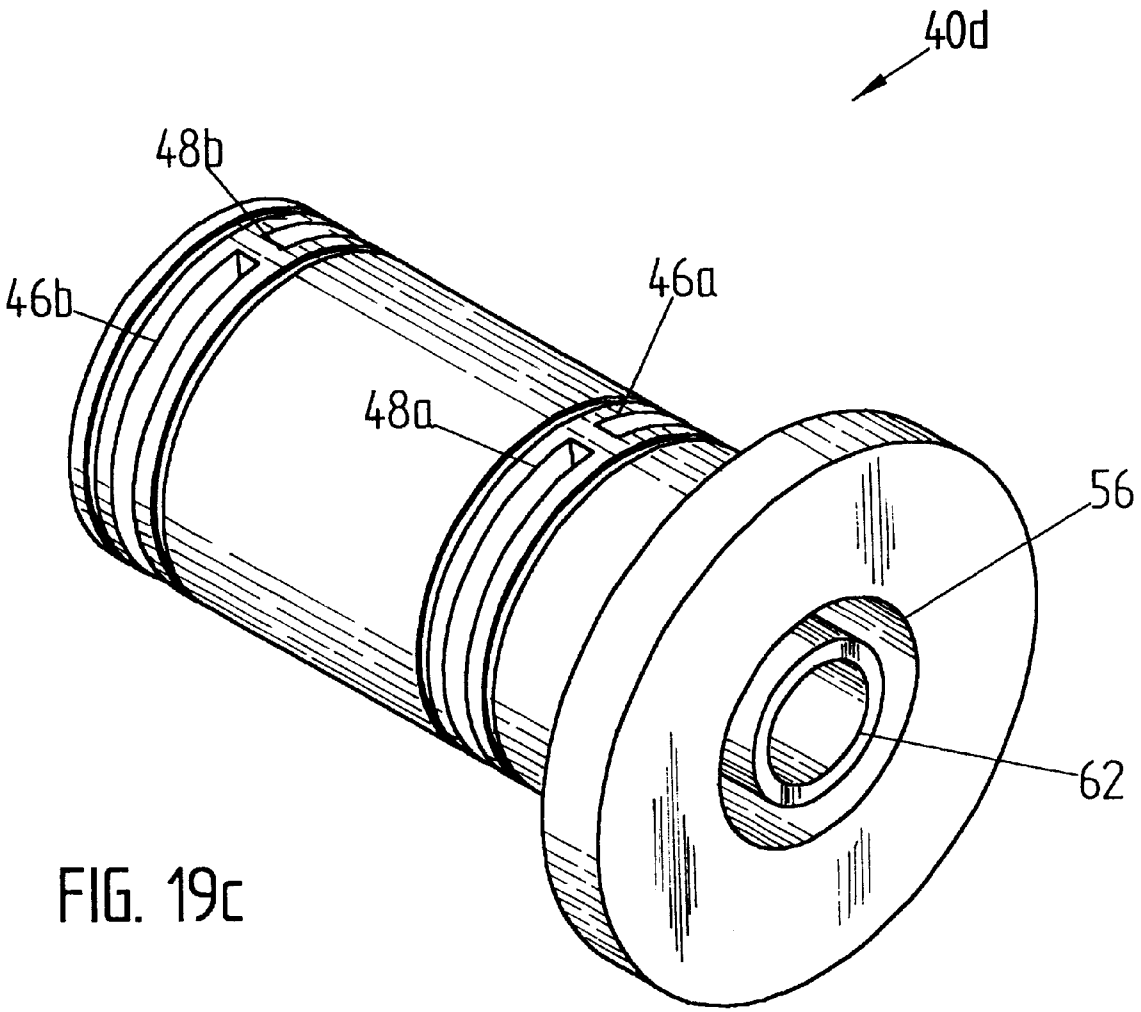
FIG. 19*c* is an isometric view of an alternative internal stator for the power device of FIG. 15, the alternative internal stator used when the device operates as a two-stroke pump, compressor, fluid-driven motor or expander.
Figure 19E:
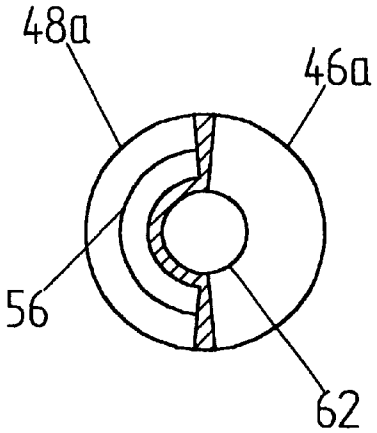
FIG. 19*e* is a sectional view of taken along line 19*e*—19*e* of FIG. 19*d*.
Figure 19G:
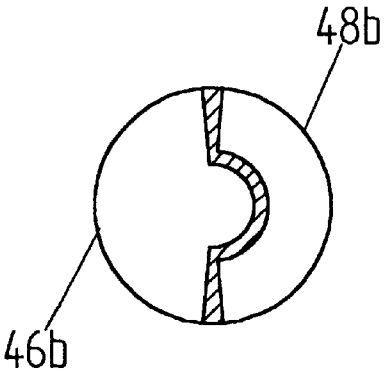
FIG. 19*g* is a sectional view of taken along line 19*g*—19*g* of FIG. 19*d*.
Figure 19H:
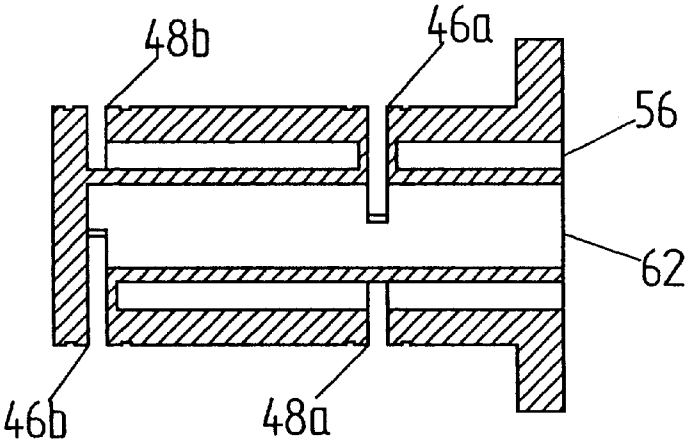
FIG. 19*h* is a sectional view of taken along line 19*h*—19*h* of FIG. 19*d*.
Figure 19D:
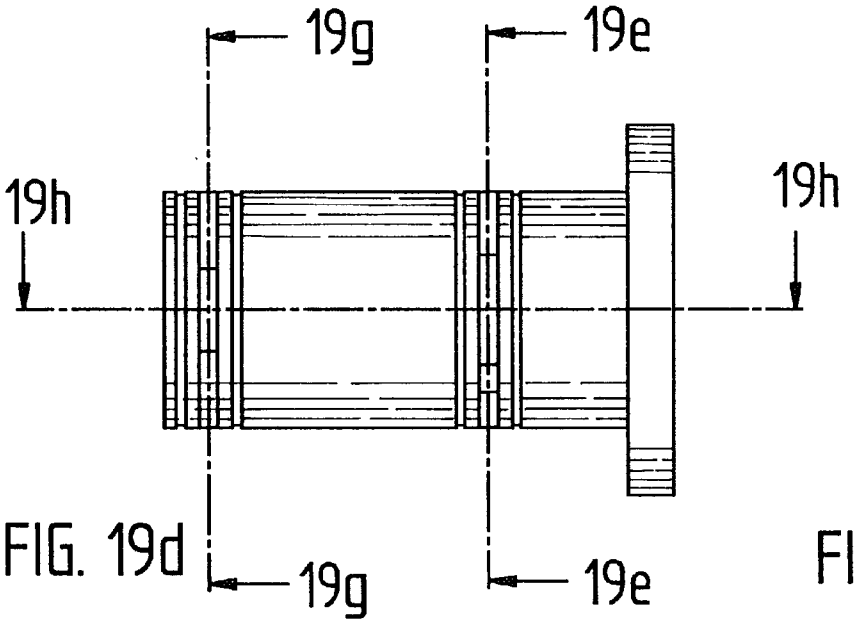
FIG. 19*d* is a side view of the alternative central internal stator of FIG. 19*c*.

In addition to the internal combustion engine embodiment discussed above, a two-stroke rotary power device of the invention can serve as a pump, compressor, fluid-driven motor or an expander device by replacing the central internal stator member with a stator of the sort shown in FIG. 19. The central stator 40*d* depicted in FIGS. 19, 19*a*, 19*b* and 19*f* comprises two pairs of axially displaced intake 46*a*, 46*b* and discharge 48*a*, 48*b* ports, each port defined over 180° of angular displacement. Each angularly adjacent pair of intake and discharge ports has a 180° angular relationship with respect to the other axially displaced pair. In this embodiment the intake ports 46*a* and 46*b* are connected to a common axial intake channel 62 and the discharge ports 48*a* and 48*b* are connected to separate axial discharge channels 56*a* and 56*b*, respectively. In another embodiment, shown in FIGS. 19*c*, 19*d*, 19*e*, 19*g* and 19*h*, the intake ports are connected to a common intake channel 62 and the discharge ports are also connected to a common annular discharge channel 56. In functioning as a pump or compressor the rotor assembly is made to rotate by coupling the end shaft to a driving means such as a motor. The pistons, in response to the action of cam followers on cam tracks, reciprocate while openings 94*a* and 94*b* of the working cylinders alternatively register with corresponding inlet (46*a*, 46*b*) and outlet ports (48*a*, 48*b*) in the stator 40*d*, thus performing intake and discharge functions. Each time the rotor completes a 180° angular displacement, each piston completes one stroke, performing a simultaneous intake at one end of the respective working cylinder and a discharge at the opposing end. In functioning as a fluid-driven motor, pressurized fluid is received in an axial intake channel 62 and causes the reciprocation of the pistons 80 in respective bores 92. At the same time the action of the cam followers 102 and 104 on the cam track 30 imparts a torque on the rotor assembly during the intake stroke, thus causing the rotation of the assembly and the discharge of the depressurized fluid during the subsequent discharge stroke. The two intake ports 46*a* and 46*b* are connected to a common axial channel 62 connecting these ports with the exterior. The discharge ports 48*a* and 48*b* are respectively connected to separate axial channels 56*a* and 56*b*, or, alternately, are connected to a common annular discharge channel 56 as shown in FIG. 19*c*. The cutout portion 68 provides common discharge header for discharge axial channels 56*a* and 56*b*.

As will be understood by those skilled in the art, various embodiments other than those described in detail in the specification are possible without departing from the scope of the invention will occur to those skilled in the art. It is, therefore, to be understood that the invention is to be limited only by the appended claims.

What is claimed is:

1. An axial piston rotary power device comprising a stator portion and a rotor portion, the rotor portion comprising a rotatable shaft extending along an axis of the device, wherein the stator portion comprises:

an external stator portion defining a generally cylindrical interior;

the external stator portion comprising a back plate portion forming one of two ends of the generally cylindrical interior, a front plate portion forming the second end of the generally cylindrical interior, the front plate having a central throughhole within which the rotatable shaft is journaled;

a cylindrical internal stator portion projecting from the back plate portion into the cylindrical interior along the axis of the device so as to define an annular space extending between the internal and external stator portions, the internal stator portion having a plurality of passageways formed therein, each of the passageways comprising a channel parallel to the axis, each of the channels communicating with at least one respective radial port formed in the internal stator at a respective selected axial position, at least one of the passageways comprising an inlet passageway, at least one of the passageways comprising an exhaust passageway; and an axially undulating guide track surface;

and wherein the rotor portion further comprises:

a cylindrical block fixedly attached to the shaft, the block rotatable within the annular space between the internal stator portion and the guide track surface, the block comprising a central cylindrical bore for receiving the internal stator, the block further comprising a selected number of working cylinders parallel to the axis of the device, each of the working cylinders spaced apart from the axis of the device by a single selected radial distance, each of the working cylinders having a radially inwardly directed end opening adjacent each of the two ends thereof, one of the end openings of each cylinder communicating with the central cylindrical bore at a first of the selected axial positions, the second of the end openings of each cylinder communicating with the central cylindrical bore at a second of the selected axial positions;

each of the working cylinders further comprising a respective axial cam follower slot extending outwardly through an outer wall of the cylindrical block;

the selected number of pistons, each piston slidably received in a respective one of the selected number of working cylinders;

the selected number of pins, each of the pins extending through a respective cam follower slot, each of the pins connecting a respective piston to a respective cam follower, each of the cam followers engaging the guide track surface.

2. The axial piston rotary power device of claim 1 wherein the axially undulating guide track surface comprises a portion of a tubular cylindrical element fixedly attached to the back plate.

3. The axial piston rotary power device of claim 1 wherein the axially undulating guide track surface comprises a portion of two coaxial tubular cylindrical elements, each of the two cylindrical elements fixedly attached to the back plate.

4. The axial piston rotary power device of claim 1 wherein the axially undulating guide track surface is defined by a groove cut into the external stator portion.

5. The axial piston rotary power device of claim 1 wherein the axially undulating guide track surface comprises a first pair of points at which the surface is a maximum distance from the back plate and a second pair of points at which the surface is a minimum distance therefrom;

the at least one inlet passageway comprises a first radial inlet port at the first selected axial position, the first radial inlet port communicating exactly once with the first of the two radial end openings in each of the cylinders in the course of each rotation of the block, the at least one inlet passageway further comprising a second radial inlet port at the second selected axial position, the second radial inlet port communicating exactly once with the second of the two radial end openings in each of the cylinders during the course of the each rotation of the block;

the at least one exhaust passageway comprises a first exhaust port at the first selected axial position, the first exhaust port communicating with the first of the two radial end openings in each of the cylinders exactly once during each rotation of the block, the at least one exhaust passageway further comprising a second exhaust port at the second selected axial position, the second exhaust port communicating with the second of the two radial end openings in each of the cylinders exactly once during each rotation of the block;

the plurality of passageways further comprises two ignition passageways, a first of the ignition passageways comprising a first ignition port at the first selected axial position, the first ignition port communicating with the first of the two radial end openings in each of the cylinders exactly once during each rotation of the block, the second of the ignition passageways comprising a second ignition port at the second selected axial position, the second ignition port communicating with the second of the two radial end openings in each of the cylinders exactly once during each rotation of the block, wherein each of the ignition ports is adapted to receive a respective spark plug;

whereby the axial piston rotary power device is adapted to function as a four stroke internal combustion engine.

6. The four stroke internal combustion engine of claim 5 wherein the plurality of passageways comprises four passageways comprising one inlet passageway and one exhaust passageway.

7. The four stroke internal combustion engine of claim 5 wherein the plurality of passageways comprises five passageways comprising one inlet passageway and two exhaust passageways.

8. The four stroke internal combustion engine of claim 5 wherein the plurality of passageways comprises four passageways comprising two inlet passageways and one exhaust passageway.

9. The axial piston rotary power device of claim 1 wherein:

the axially undulating guide track surface comprises exactly one point at which the surface is a maximum distance from the back plate and exactly one point at which the surface is a minimum distance therefrom;

each working cylinder further comprises two axially spaced apart medial openings, a first of the medial openings in each cylinder communicating with the central cylindrical bore at a third of the selected axial positions, the second of the two medial openings in each cylinder communicating with the central cylindrical bore at a fourth of the selected axial positions;

the at least one inlet passageway comprises an air inlet passageway comprising a first radial air inlet port at the first selected axial position, the first radial air inlet port communicating with the first of the two radial end openings in each of the cylinders exactly once during each rotation of the block, the at least one air inlet passageway further comprising a second radial air inlet port at the second selected axial position, the second radial air inlet port communicating with the second of the two radial end openings in each of the cylinders exactly once during each rotation of the block;

the at least one exhaust passageway comprises a first exhaust port at the third selected axial position, the first exhaust port communicating with the first of the two medial openings in each of the cylinders exactly once during each rotation of the block, and with a second exhaust port at the fourth selected axial position, the second exhaust port communicating with the second of the two medial openings in each of the cylinders exactly once during each rotation of the block;

the plurality of passageways further comprises two fuel injection passageways, a first of the fuel injection passageways comprising a first fuel injection port disposed at the first selected axial position diagonally opposite the first inlet port, the first fuel injection port communicating with the first of the two radial end openings in each of the cylinders exactly once during each rotation of the block, the second of the fuel injection passageways comprising a second fuel injection port disposed at the second selected axial position diagonally opposite the second inlet port, the second fuel injection port communicating with the second of the two radial openings in each of the cylinders exactly once during each rotation of the block;

whereby the axial piston rotary power device is adapted to function as a two stroke internal combustion engine.

10. The two stroke internal combustion engine of claim 9 wherein the plurality of passageways comprises four passageways comprising one inlet passageway and one exhaust passageway.

11. The two stroke internal combustion engine of claim 9 wherein the plurality of passageways comprises five passageways comprising one inlet passageway and two exhaust passageways.

12. The two stroke internal combustion engine of claim 9 wherein the plurality of passageways comprises five passageways comprising two inlet passageways and one exhaust passageway.

13. The axial piston rotary power device of claim 1 wherein the axially undulating guide track surface comprises a first pair of points at which the surface is a maximum distance from the back plate and a second pair of points at which the surface is a minimum distance therefrom;

the at least one inlet passageway comprises first and second diagonally opposed radial inlet ports at the first selected axial position, the first and second radial inlet ports communicating with the first of the two end openings in each of the cylinders exactly once during each rotation of the block, the at least one inlet passageway further comprising third and fourth diagonally opposed radial inlet ports at the second selected axial position, the third and fourth radial inlet ports communicating with the second of the two radial end openings in each of the cylinders exactly once during each rotation of the block;

the at least one exhaust passageway comprises first and second diagonally opposed exhaust ports at the first selected axial position, the first and second exhaust ports communicating with the first of the two radial openings in each of the cylinders exactly once during each rotation of the block, the at least one exhaust passageway further comprising third and fourth diagonally opposed exhaust ports at the second selected axial position, the third and fourth exhaust ports communicating with the second of the two radial openings in each of the cylinders exactly once during each rotation of the block;

whereby the axial piston rotary power device is adapted to function as one of a four stroke pump, a four stroke compressor, a four stroke fluid-driven pump, a four stroke fluid-driven compressor and a four stroke fluid-driven motor.

14. The four stroke rotary power device of claim 13 wherein one of the inlet and exhaust passageways comprises an axial channel and the other of the inlet and the exhaust passageways comprises an annular channel disposed about the axial channel.

15. The four stroke rotary power device of claim 13 wherein the number of passageways comprises five passageways comprising one intake passageway and four exhaust passageways.

16. The four stroke rotary power device of claim 13 wherein the number of passageways comprises five passageways comprising four intake passageways and one exhaust passageway.

17. The axial piston rotary power device of claim 1 wherein the axially undulating guide track surface comprises exactly one point at which the surface is a maximum distance from the back plate and exactly one point at which the surface is a minimum distance therefrom;

the at least one inlet passageway comprises a first radial inlet port at the first selected axial position, the first radial inlet port communicating with the first of the two end openings in each of the cylinders exactly once during each rotation of the block, the at least one inlet passageway further comprising a second radial inlet port at the second selected axial position, the second radial inlet port communicating with the second of the two radial end openings in each of the cylinders exactly once during each rotation of the block;

the at least one exhaust passageway comprises a first exhaust port at the first selected axial position, the first exhaust port communicating with the first of the two end openings in each of the cylinders exactly once during each rotation of the block, the at least one exhaust passageway further comprising a second exhaust port at the second selected axial position, the second exhaust port communicating with the second of the two radial openings in each of the cylinders exactly once during each rotation of the block;

whereby the axial piston rotary power device is adapted to function as one of a two stroke pump, a two stroke compressor, a two stroke fluid-driven pump, a two stroke fluid-driven compressor and a two stroke fluid-driven motor.

18. The two stroke rotary power device of claim 17 wherein one of the inlet and exhaust passageways comprises an axial channel and the other of the inlet and the exhaust passageways comprises an annular channel disposed about the axial channel.

19. The two stroke rotary power device of claim 17 wherein the number of passageways comprises three passageways comprising one inlet passageway and two exhaust passageways.

20. The four stroke rotary power device of claim 17 wherein the number of passageways comprises three passageways comprising two inlet passageways and one exhaust passageway.

21. The rotary power device of claim 1 wherein the cylindrical block comprises a plurality of axially oriented cooling channels, each of the cooling channels communicating with at least one cooling throughhole in the back plate, each of the cooling channels further communicating with at least one cooling throughhole in the front plate.

22. The rotary power device of claim 1 wherein the central stator portion further comprises at least one axial lubrication passageway adapted to supply lubricant fluid to the clearance space between the central stator portion and the block.

23. A four stroke internal combustion engine having an output shaft fixedly attached to a rotatable cylindrical block, wherein the cylindrical block comprises:

an outer wall and a central cylindrical bore extending through the block along an axis of the shaft;

a selected number of working cylinders parallel to the shaft and disposed at a single radial distance from the axis of the shaft, each of the working cylinders having a separate radially inwardly directed end opening adjacent each of two ends thereof, one of the end openings of each cylinder communicating with the central cylindrical bore at a first selected axial position, the second of the end openings of each cylinder communicating with the central cylindrical bore at a second selected axial position;

each of the working cylinders further comprising a respective axial cam follower slot extending outwardly through the outer wall of the cylindrical block;

the selected number of pistons, each piston slidably received in a respective one of the selected number of working cylinders;

the selected number of pins, each of the pins extending through a respective cam follower slot, each of the pins connecting a respective piston to a respective cam follower; and wherein the engine further comprises:

an internal stator portion received in the cylindrical bore of the cylindrical block, the internal stator portion having a plurality of passageways formed therein, each of the passageways comprising a channel parallel to the axis of the shaft, each of the channels communicating with at least one respective radial port formed in the internal stator at one of the selected axial positions, at least one of the plurality of passageways comprising an inlet passageway, a second at least one of the plurality of passageways comprising an exhaust passageway, and two of the passageways comprising ignition passageways comprising respective ignition ports, each of the ignition ports for receiving a spark plug therein; and an axially undulating guide track surface disposed on an external stator portion, the axially undulating guide track surface engaged by each of the cam followers, the axially undulating guide track surface having a first pair of points at which the surface is a maximum axial distance from the first selected axial position and a second pair of points at which the surface is a minimum axial distance from the first selected axial position.

24. The axial piston rotary power device of claim 23 wherein the axially undulating guide track surface comprises a portion of a tubular cylindrical element fixedly attached to the back plate.

25. The axial piston rotary power device of claim 23 wherein the axially undulating guide track surface comprises a portion of two coaxial tubular cylindrical elements, each of the two cylindrical elements fixedly attached to the back plate.

26. The axial piston rotary power device of claim 23 wherein the axially undulating guide track surface is defined by a groove cut into the external stator portion.

27. A two stroke internal combustion engine having an output shaft fixedly attached to a rotatable cylindrical block, wherein the cylindrical block comprises:

an outer wall and a central cylindrical bore extending through the block along an axis of the shaft;

a selected number of working cylinders parallel to the shaft and disposed at a single radial distance from the axis of the shaft, each of the working cylinders having a separate radially inwardly directed end opening adjacent each of two ends thereof, one of the end openings of each cylinder communicating with the central cylindrical bore at a first selected axial position, the second of the end openings of each cylinder communicating with the central cylindrical bore at a second selected axial position;

each of the working cylinders further having a separate radially inwardly directed first medial opening communicating with the central cylindrical bore at a third selected axial position disposed between the first and the second axial positions, the third axial position closer to the first axial position than to the second, each of the working cylinders further having a separate radially inwardly directed second medial opening communicating with the central cylindrical bore at a fourth selected axial position disposed between the first and the second axial positions, the fourth axial position closer to the second axial position than to the first;

each of the working cylinders further comprising a respective axial cam follower slot extending outwardly through the outer wall of the cylindrical block;

the selected number of pistons, each piston slidably received in a respective one of the selected number of working cylinders;

the selected number of pins, each of the pins extending through a respective cam follower slot, each of the pins connecting a respective piston to a respective cam follower; and wherein the engine further comprises:

an internal stator portion received in the cylindrical bore of the cylindrical block, the internal stator portion having a plurality of passageways formed therein, each of the passageways comprising a channel parallel to the axis of the shaft, each of the channels communicating with at least one respective radial port formed in the internal stator at one of the selected axial positions, at least one of the plurality of passageways comprising an inlet passageway, a second at least one of the plurality of passageways comprising an exhaust passageway, and two of the plurality of passageways comprising fuel injection passageways; and an axially undulating guide track surface disposed on an external stator portion, the axially undulating guide track surface engaged by each of the cam followers, the axially undulating guide track surface having exactly one point at which the surface is a maximum axial distance from the first selected axial position and a exactly one point at which the surface is a minimum axial distance from the first selected axial position.

28. The axial piston rotary power device of claim 27 wherein the axially undulating guide track surface comprises a portion of a tubular cylindrical element fixedly attached to the back plate.

29. The axial piston rotary power device of claim 27 wherein the axially undulating guide track surface comprises a portion of two coaxial tubular cylindrical elements, each of the two cylindrical elements fixedly attached to the back plate.

30. The axial piston rotary power device of claim 27 wherein the axially undulating guide track surface is defined by a groove cut into the external stator portion.

31. A pump having an input shaft fixedly attached to a rotatable cylindrical block, wherein the cylindrical block comprises:

an outer wall and a central cylindrical bore extending through the block along an axis of the shaft;

a selected number of working cylinders parallel to the shaft and disposed at a single radial distance from the axis of the shaft, each of the working cylinders having a separate radially inwardly directed end opening adjacent each of two ends thereof, one of the end openings of each cylinder communicating with the central cylindrical bore at a first selected axial position, the second of the end openings of each cylinder communicating with the central cylindrical bore at a second selected axial position;

each of the working cylinders further comprising a respective axial cam follower slot extending outwardly through the outer wall of the cylindrical block;

the selected number of pistons, each piston slidably received in a respective one of the selected number of working cylinders;

the selected number of pins, each of the pins extending through a respective cam follower slot, each of the pins connecting a respective piston to a respective cam follower; and wherein the pump further comprises:

an internal stator portion received in the cylindrical bore of the cylindrical block, the internal stator portion having a plurality of passageways formed therein, each of the passageways comprising a channel parallel to the axis of the shaft, each of the channels communicating with at least one respective radial port formed in the internal stator at one of the selected axial positions, at least one of the plurality of passageways comprising an inlet passageway, a second at least one of the plurality of passageways comprising an exhaust passageway; and an axially undulating guide track surface disposed on an external stator portion, the axially undulating guide track surface engaged by each of the cam followers, the axially undulating guide track surface having a selected number, equal to or greater than one, of points at which the surface is a maximum axial distance from the first selected axial position and the selected number of points at which the surface is a minimum axial distance from the first selected axial position.

* * * * *